US009620318B2

(12) United States Patent
Matthiesen et al.

(10) Patent No.: US 9,620,318 B2
(45) Date of Patent: Apr. 11, 2017

(54) REFLOWABLE CIRCUIT PROTECTION DEVICE

(75) Inventors: Martyn A. Matthiesen, Fremont, CA (US); Jianhua Chen, Sunnyvale, CA (US); Matthew P. Galla, Holly Springs, NC (US); Anthony Vranicar, Santa Clara, CA (US); Wayne Montoya, Redwood City, CA (US); Christopher Pasma, Mountain View, CA (US)

(73) Assignee: Littlefuse, Inc., Chicago, IL (US)

( * ) Notice: Subject to any disclaimer, the term of this patent is extended or adjusted under 35 U.S.C. 154(b) by 599 days.

(21) Appl. No.: 13/567,784

(22) Filed: Aug. 6, 2012

(65) Prior Publication Data

US 2013/0200984 A1 Aug. 8, 2013

Related U.S. Application Data

(60) Provisional application No. 61/523,158, filed on Aug. 12, 2011, provisional application No. 61/645,580, filed on May 10, 2012.

(51) Int. Cl.
*H01H 37/76* (2006.01)

(52) U.S. Cl.
CPC ..... *H01H 37/761* (2013.01); *H01H 2037/768* (2013.01)

(58) Field of Classification Search
CPC ..... H01H 37/761; H01H 2037/768
USPC ..... 337/401, 402, 407–408, 297, 152, 153, 337/186
See application file for complete search history.

(56) References Cited

U.S. PATENT DOCUMENTS

| | | | | | |
|---|---|---|---|---|---|
| 3,638,083 | A | * | 1/1972 | Dornfeld et al. | 361/321.1 |
| 3,725,835 | A | * | 4/1973 | Hopkins et al. | 337/140 |
| 3,733,218 | A | * | 5/1973 | Begun | 134/38 |
| 3,763,454 | A | * | 10/1973 | Zandonatti | 337/404 |
| 3,846,679 | A | * | 11/1974 | Jost et al. | 361/165 |
| 3,905,004 | A | * | 9/1975 | Szevernyi et al. | 337/104 |

(Continued)

FOREIGN PATENT DOCUMENTS

| | | | |
|---|---|---|---|
| JP | 2001-243863 | A | 9/2001 |
| WO | WO-2009/130946 | A1 | 10/2009 |

OTHER PUBLICATIONS

International Search Report for International Application No. PCT/US2012/049820, mailed Nov. 20, 2012.

*Primary Examiner* — Anatoly Vortman

(57) ABSTRACT

A circuit protection device includes a substrate with first and second electrodes connected to the circuit to be protected. The circuit protection device also includes a heater element. A sensing element facilitates an electrical connection between the first and second electrodes. A flux material is provided around the sensing element. In a preferred embodiment, the flux contains a first component that is a polar material and a second component that is a non-polar material. A spring element exerts a force on the sensing element. The sensing element resists the force applied by the spring element. Upon detection of an activation, or fault, condition, the sensing element loses resilience and no longer resists the force exerted by the spring element, resulting in the spring element severing the electrical connection between the first and second electrodes. The flux allows the spring element to sever the electrical connection without dragging the sensing element.

15 Claims, 22 Drawing Sheets

(56) References Cited

U.S. PATENT DOCUMENTS

| | | | | |
|---|---|---|---|---|
| 4,514,718 | A | 4/1985 | Birx | |
| 4,514,719 | A * | 4/1985 | Suzuki et al. | 370/503 |
| 4,544,988 | A * | 10/1985 | Hochstein | 361/211 |
| 4,658,101 | A * | 4/1987 | Akimoto et al. | 200/16 R |
| 4,864,824 | A * | 9/1989 | Gabriel et al. | 60/527 |
| 5,011,546 | A * | 4/1991 | Frazier et al. | 148/23 |
| 5,014,036 | A * | 5/1991 | Komoto | 337/407 |
| 5,097,247 | A * | 3/1992 | Doerrwaechter | H01H 85/046 29/623 |
| 5,612,662 | A * | 3/1997 | Drekmeier et al. | 337/389 |
| 5,770,993 | A * | 6/1998 | Miyazawa et al. | 337/160 |
| 5,831,507 | A * | 11/1998 | Kasamatsu et al. | 337/4 |
| 6,348,851 | B1 * | 2/2002 | Wyser et al. | 337/411 |
| 6,396,382 | B1 * | 5/2002 | Ross | 337/393 |
| 6,506,448 | B1 * | 1/2003 | Minogue | 427/216 |
| 6,897,760 | B2 * | 5/2005 | Kawata et al. | 337/328 |
| 6,917,276 | B1 * | 7/2005 | Menard et al. | 337/140 |
| 7,345,570 | B2 * | 3/2008 | Kawanishi | 337/142 |
| 7,385,474 | B2 * | 6/2008 | Kawanishi | 337/142 |
| 7,864,024 | B2 * | 1/2011 | Schlenker et al. | 337/407 |
| 2006/0273876 | A1 * | 12/2006 | Pachla et al. | 337/140 |
| 2008/0237022 | A1 * | 10/2008 | Miki | 200/536 |
| 2008/0297301 | A1 * | 12/2008 | Onken et al. | 337/219 |
| 2010/0033295 | A1 * | 2/2010 | Kent et al. | 337/405 |
| 2010/0245022 | A1 | 9/2010 | Galla et al. | |
| 2010/0245027 | A1 | 9/2010 | Matthiesen et al. | |
| 2011/0121936 | A1 * | 5/2011 | Dietsch et al. | 337/290 |
| 2011/0211284 | A1 | 9/2011 | Yoneda | |
| 2012/0194315 | A1 | 8/2012 | Matthiesen et al. | |
| 2012/0194317 | A1 | 8/2012 | Vranicar et al. | |
| 2012/0194958 | A1 | 8/2012 | Matthiesen et al. | |
| 2013/0200984 | A1 * | 8/2013 | Matthiesen et al. | 337/186 |

* cited by examiner

REFLOWABLE CIRCUIT PROTECTION DEVICE

CROSS-REFERENCE TO RELATED APPLICATIONS

This application claims priority from U.S. Provisional Application No. 61/523,158, filed Aug. 12, 2011, and from U.S. Provisional Application No. 61/645,580, filed May 10, 2012, the disclosures of each of which are incorporated herein by reference.

BACKGROUND

Field of the Invention

The present invention relates generally to electronic protection circuitry. More, specifically, the present invention relates to an electrically activated surface mount circuit protection device.

Introduction to the Invention

Protection circuits are often times utilized in electronic circuits to isolate failed circuits from other circuits. For example, the protection circuit may be utilized to prevent electrical or thermal fault condition in electrical circuits, such as in lithium-ion battery packs. Protection circuits may also be utilized to guard against more serious problems, such as a fire caused by a power supply circuit failure.

One type of protection circuit is a thermal fuse. A thermal fuse functions similar to that of a typical glass fuse. That is, under normal operating conditions the fuse behaves like a short circuit and during a fault condition the fuse behaves like an open circuit. Thermal fuses transition between these two modes of operation when the temperature of the thermal fuse exceeds a specified temperature. To facilitate these modes, thermal fuses include a conduction element, such as a fusible wire, a set of metal contacts, or set of soldered metal contacts, that can switch from a conductive to a non-conductive state. A sensing element may also be incorporated. The physical state of the sensing element changes with respect to the temperature of the sensing element. For example, the sensing element may correspond to a low melting metal alloy or a discrete melting organic compound that melts at an activation temperature. When the sensing element changes state, the conduction element switches from the conductive to the non-conductive state by physically interrupting an electrical conduction path.

In operation, current flows through the fuse element. Once the sensing element reaches the specified temperature, it changes state and the conduction element switches from the conductive to the non-conductive state.

One disadvantage of some existing thermal fuses is that during installation of the thermal fuse, care must be taken to prevent the thermal fuse from reaching the temperature at which the sensing element changes state. As a result, some existing thermal fuses cannot be mounted to a circuit panel via reflow ovens, which operate at temperatures that will cause the sensing element to open prematurely.

Further disadvantages include size and versatility. Circuit protection devices are often too tall to meet the height constraints for circuit board mounted devices. Circuit protection devices also often do not provide the versatility to allow the circuit protection device to activate under all the conditions necessary to adequately protect the circuit.

Thermal fuses described in U.S. application Ser. No. 12/383,595, filed Mar. 24, 2009 and published as U.S. Publication No. 2010/0245022 A1, now U.S. Pat. No. 8,581,686; U.S. application Ser. No. 12/383,560, filed Mar. 24, 2009 and published as U.S. Publication No. 2010/0245027 A1, now U.S. Pat. No. 8,289,122; U.S. application Ser. No. 13/019,976, filed Feb. 2, 2011 and published as U.S. Publication No. 2012/0194317 A1, now U.S. Pat. No. 8,941,461; U.S. application Ser. No. 13/019,983, filed Feb. 2, 2011 and published as U.S. Publication No. 2012/0194315 A1; and U.S. application Ser. No. 13/209,146, filed Aug. 12, 2011 and published as U.S. Publication No. 2012/0194958 A1, the disclosures of each of which are incorporated herein by reference, address the disadvantages described above. While progress has been made in providing improved circuit protection devices, there remains a need for improved circuit protection devices.

SUMMARY

A circuit protection device includes a substrate with first and second electrodes connected to the circuit to be protected. The circuit protection device also includes a heater element. A sensing element facilitates an electrical connection between the first and second electrodes. A flux material is provided around the sensing element, and in a preferred embodiment the flux comprises a first component that is a polar material and a second component that is a non-polar material. A spring element exerts a force on the sensing element. The sensing element resists the force applied by the spring element. Upon detection of an activation, or fault, condition, the sensing element loses resilience and no longer resists the force exerted by the spring element, resulting in the spring element severing the electrical connection between the first and second electrodes. The flux allows the spring element to sever electrical connection without dragging the sensing element.

DETAILED DESCRIPTION

Figure 1:
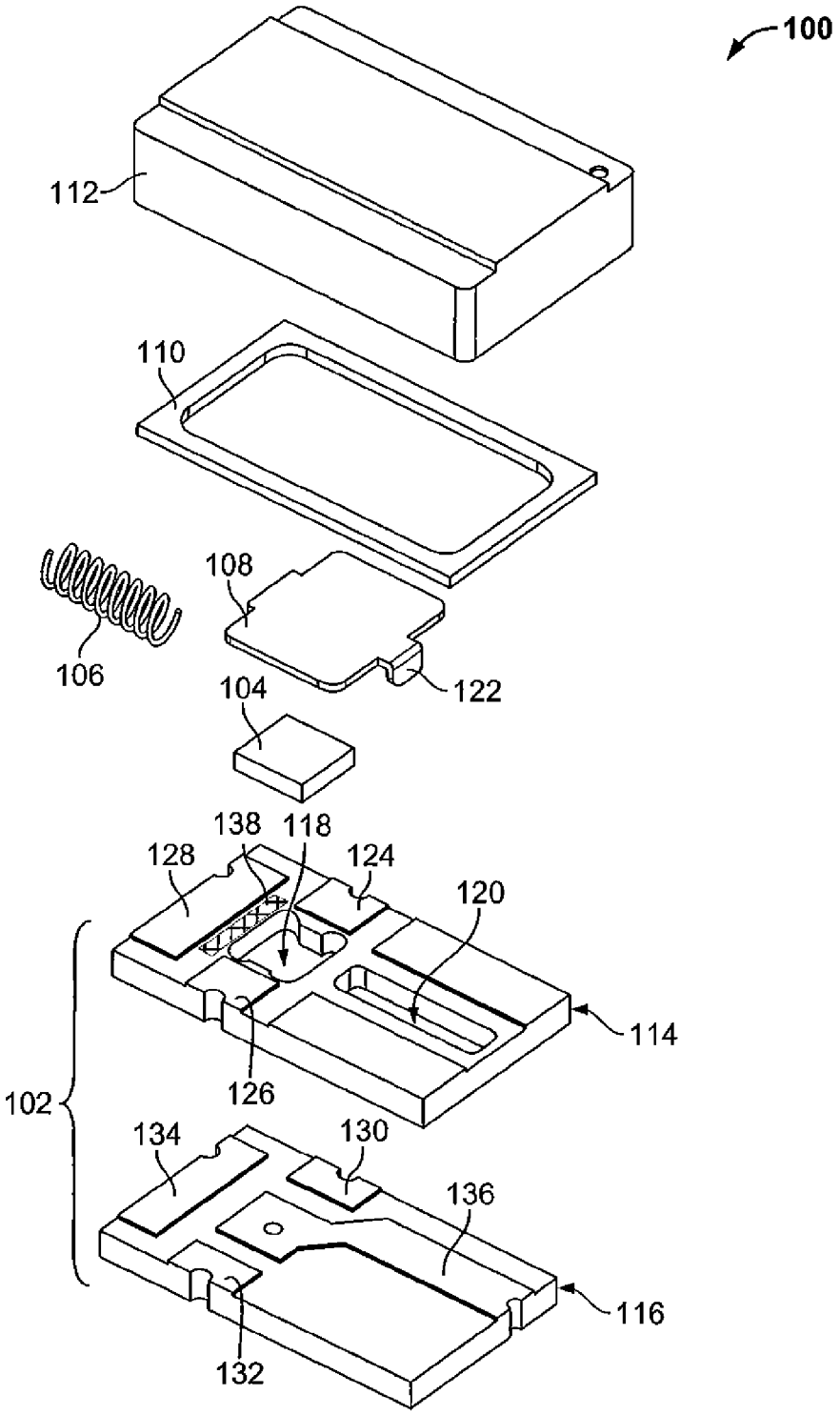
FIG. 1 is an exploded view of an unassembled exemplary three-function reflowable circuit protection device.

FIG. 1 is an exploded view of an unassembled exemplary three-function reflowable circuit protection device 100. The circuit protection device 100 includes a substrate 102, a heater element 104, a spring element 106, a sliding contact 108, and a spacer 110. The circuit protection device 100 may also include a cover 112.

The substrate 102 may include a printed circuit board (PCB). For the sake of explanation, the substrate 102 is described as a multilayer PCB including a top PCB 114 and a bottom PCB 116. It will be understood that the substrate 102 may also be fabricated as a single layer.

The top PCB 114 includes an opening 118 that receives the heater element 104. The height of the top PCB 114 may be set to allow the top of the heater element 104, when placed in the opening 118, to be co-planar with the top surface of the substrate 102, i.e., with the top surface of the top PCB 114. In another embodiment shown in FIG. 7 and described in more detail below, the heater element 104 may be laid up into the substrate 102 during the fabrication process. In this example, the substrate 102 may not include the opening 118.

The top PCB 114 may also include another opening 120 for receiving a cantilever portion 122 of the sliding contact 108. The opening 120 in FIG. 1 extends parallel to the length of the substrate 102, allowing the sliding contact 108 to slide in a direction parallel to the length of the substrate 102. In another embodiment shown in FIGS. 8-9 and described in more detail below, the cantilever 122 may extend away from the substrate 102 towards the cover 112. In this example, substrate 102 may not include the opening 120.

Figure 3A:
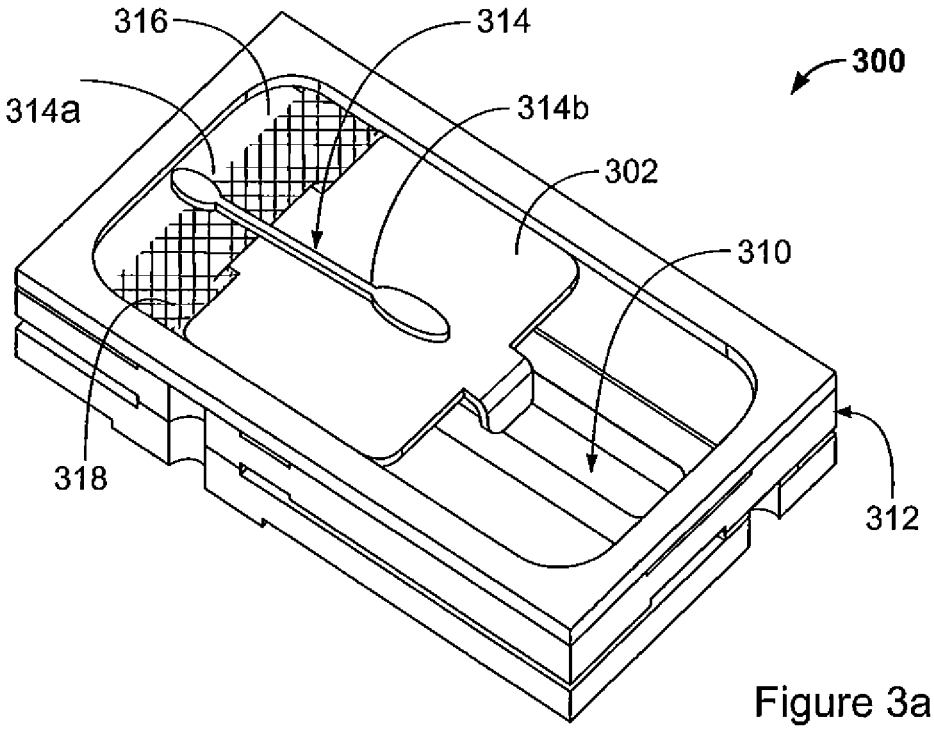
FIG. 3*a* is a circuit protection device with the sliding contact in the closed position.
Figure 3B:
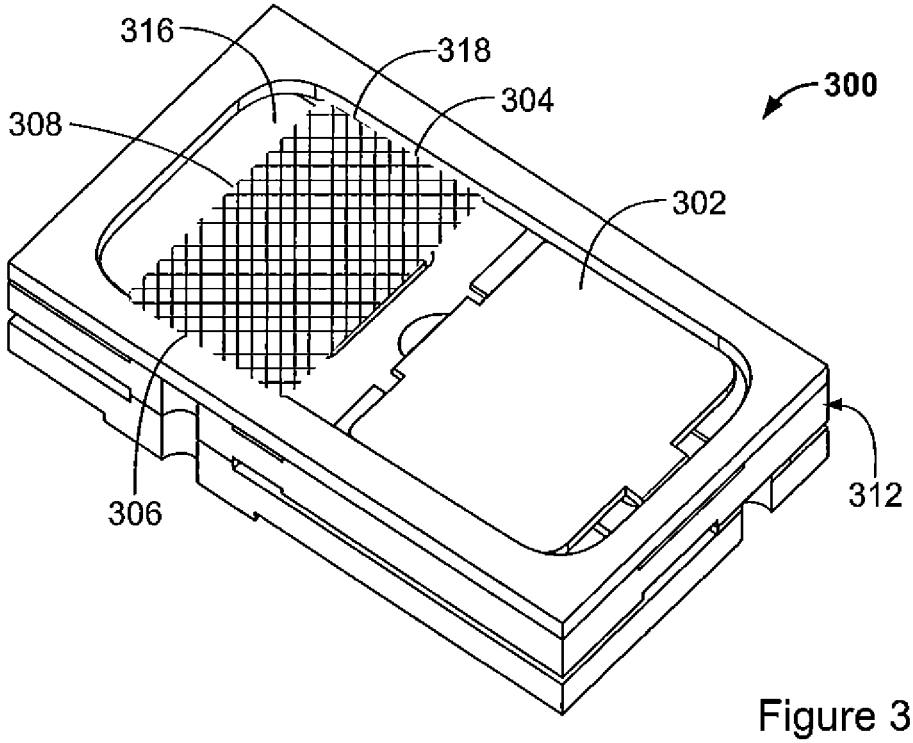
FIG. 3*b* is the circuit protection device of FIG. 3*a* with the sliding contact in the open position.

The top PCB 114 includes pads/electrodes, 124, 126 and 128. The electrodes 124 and 126 may be positioned on opposite sides of the opening 118 along a width of the top PCB 114. The electrode 128 may be positioned on a side of the opening 118 opposing the side the opening 120 is located on opposite sides of the opening 118. As shown in FIGS. 3*a*-3*b*, the sliding contact 108 bridges the electrodes 124 and 126 and the heater element 104 when the sliding contact 108 is in a ready or closed position, thus facilitating an electrical connection between the heater element 104, electrode 124 and electrode 126.

Figure 2A:
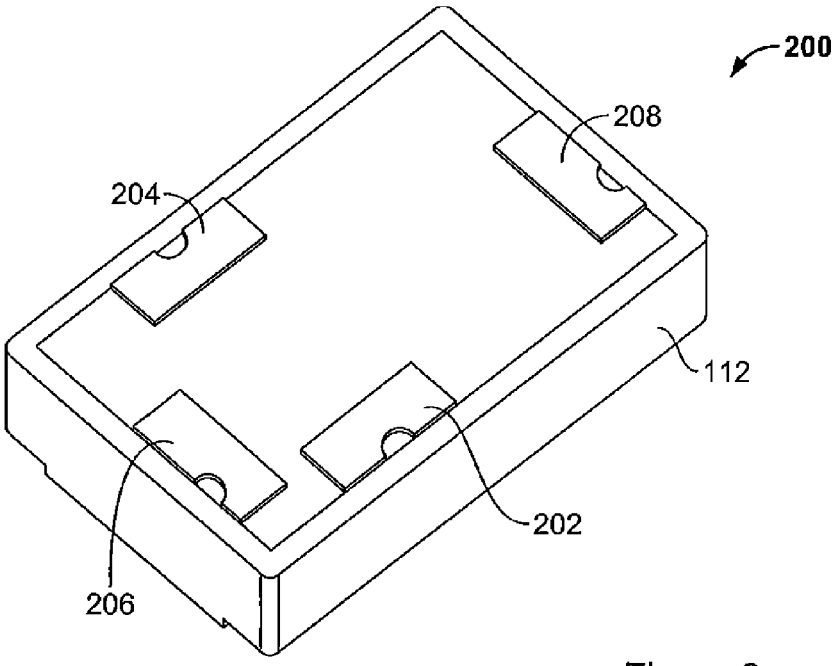
FIG. 2*a* is a bottom view an assembled circuit protection device.

The bottom PCB 116 includes pads 130, 132 and 134 corresponding to the location of the electrodes 124, 126 and 128, respectively, of the top PCB 114. The bottom PCB 116 may also include pad 136 corresponding to the location of the heater element 104. As shown in FIG. 2*a*, the bottom side of the bottom PCB 116 includes terminals corresponding to the pads 130, 132, 134 and 136 for connection to the circuit to be protected.

Figure 7:
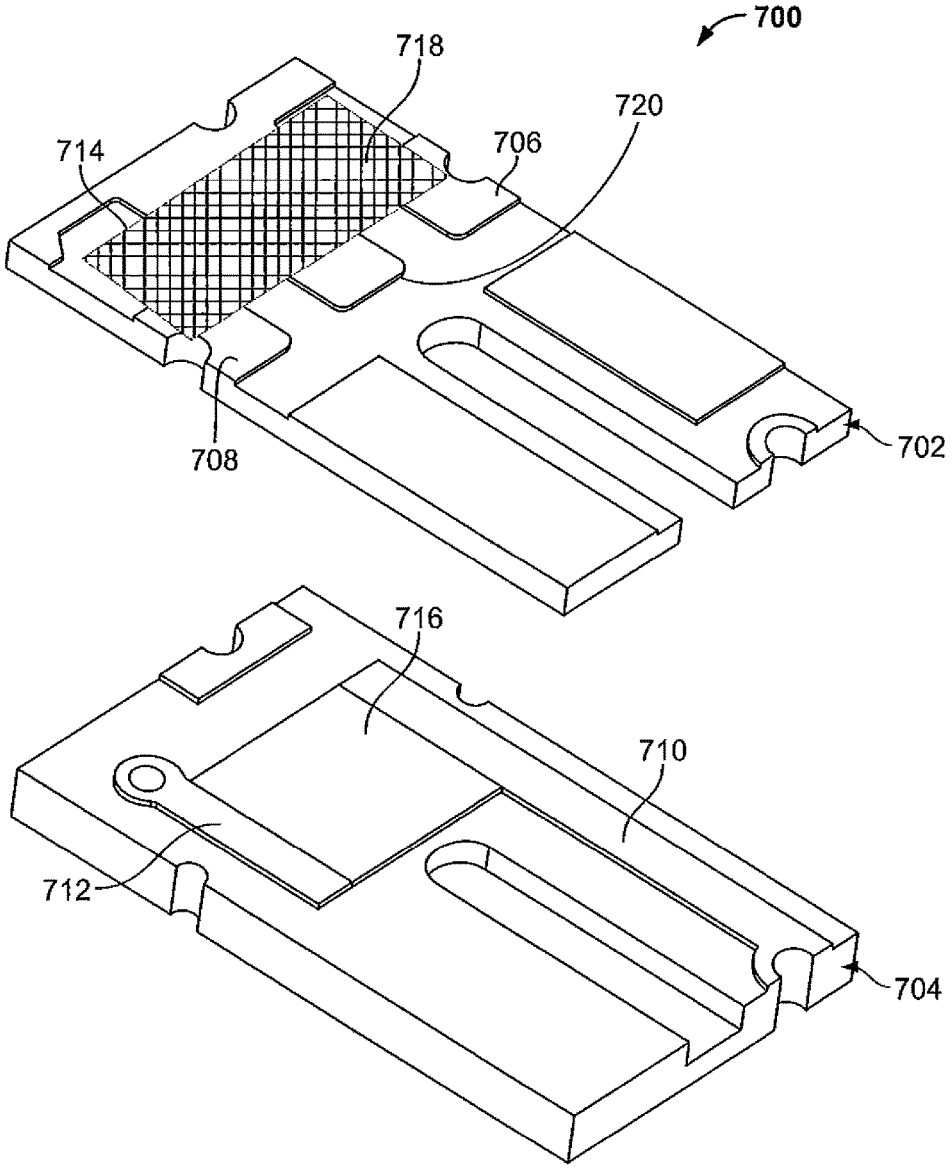
FIG. 7 is another embodiment for the substrate of a three-function reflowable circuit protection device.

As noted, the heater element 104 fits into the opening 118 in the substrate 102. The heater element 104 may also constitute another electrode of the circuit protection device 100. The heater element 104 may be a positive temperature coefficient (PTC) device, such as the PTC device disclosed in U.S. application Ser. No. 12/383,560, filed Mar. 24, 2009 and published as U.S. Publication No. 2010/0245027 A1, now U.S. Pat. No. 8,289,122, the entirety of which is incorporated herein by reference. Other heater elements, such as a conductive composite heater, that generate heat as a result of current flowing through the device, may be utilized in addition to or instead of the PTC device. In another example, the heater element 104 may be zero temperature coefficient element or constant wattage heater. As shown in FIG. 7, in another embodiment the heater element may also be a thin-film resistor or heating device laid up into the substrate during a PCB process.

The sliding contact 108 may be a conductive and planar element with the cantilever portion 122. The cantilever portion 122 fits into the opening 120. The spring element 106 is located between the cantilever 122 and a side of the opening 120. The sliding contact 108 may be fused to the heater element 104 and electrodes 124, 126 with, for example, a low melt-point sensing element (not shown). When the sensing element changes state, e.g., melts at a threshold temperature, the sliding contact 108 is no longer fused to the electrodes 124, 126 and heater element 104, and the spring element 106 expands and pushes the sliding contact 108 down the channel 120. The sensing element may thus provide mechanical, and electrical, contact between the sliding contact 108 and the electrodes 124, 126 and heater element 104.

The sensing element may be, for example, a low melt-point metal alloy, such as solder. For the sake of explanation, the sensing element is described herein as a solder. It will be understood that other suitable materials may be used as the sensing element such as, for example, a conductive thermoplastic having a softening point or melting point.

With the sliding contact 108 soldered to the heater element 104 and electrodes 124, 126, the spring element 106 between the cantilever 122 and the side of the opening 120 is held in a compressed state. When the solder that holds the sliding contact 108 to the heater element and electrodes 124, 126 melts, the spring element 106 is allowed to expand, pushing against the cantilever 122 and causing it to slide down the opening 120, which in turn pushes the sliding contact 108 off the heater element 104 and electrodes 124, 126. In this manner, the electrical connection between the heater element 104, electrode 124 and electrode 126 is broken. FIGS. 3*a* and 3*b*, described below, show a circuit protection device in a closed and an open position, respectively.

The spring element 106 may be a coil spring made of copper, stainless steel, plastic, rubber, or other materials known or contemplated to be used for coil springs. The spring element 106 may be of other compressible materials and/or structures known to those of skill in the art. For the sake of explanation, the spring element 106 is described as being held under tension in a compressed state by the sliding contact 108. It will be understood that a spring element may also be configured to be held under tension in an expanded or stretched state, such as if the spring element comprises an elastic material. In this example, when an activation condition is detected and the solder melts, the spring element may pull the sliding contact off a heater element and electrodes of the substrate.

The circuit protection device 100 is configured to open under at least three conditions. The solder can be melted by an over current condition, i.e., by a current through electrodes 124 and 126. When a current passing through the electrodes 124 and 126 reaches a threshold current, i.e., a current that exceeds a designed hold current, Joule heating will cause the solder to melt, or otherwise lose resilience, and the sliding contact 108 to move to the open position by being pushed open by the spring element 106.

The solder can be melted by an over temperature condition where the temperature of the device 100 exceeds, such as by an overheating FET or high environmental temperatures, the melting point of the solder holding the sliding contact 108 to the electrodes 124, 126 and the heater element 104. For example, the ambient temperature surrounding the circuit protection device 100 may reach a threshold temperature, such as 140° C. or higher, that causes the solder to melt or otherwise lose resilience. After the solder melts, the sliding contact 108 is pushed down the channel 120 and into an open position, thus preventing electrical current from flowing between the electrodes 124, 126 and the heater element 106.

The solder can also be melted by a controlled activation condition where the heater element 104 is activated by a control current supplied by the circuit into which the circuit protection device 100 is installed. For example, the circuit protection device may pass a current to the heater element 104 upon detection of an overvoltage in the circuit, causing the device to act as a controlled activation fuse. As the current flowing through the heater element 104 increases, the temperature of the heater element 104 may increase. The increase in temperature may cause solder to melt, or otherwise lose resilience, more quickly, resulting in the sliding contact 108 moving to an open position.

The circuit protection device 100 also includes a restraining element (not shown) that holds the sliding contact 108 in the closed position during reflow. During a reflow process, the solder holding the sliding contact 108 to the heater element 104 and electrodes 124, 126 can melt, which would result in the sliding contact 108 moving to the open position due to the force of the compressed spring 106. For example, the melt point of the solder may be approximately 140° C., while the temperature during reflow may reach more than 200° C., for example 260° C. Thus, during reflow the solder would melt, causing the spring element 106 to prematurely move the sliding contact 108 to the open position.

To prevent the force applied by the spring element 106 from opening the circuit protection device 100 during installation, the restraining element may be utilized to maintain the holding sliding contact 108 in place and resist the expansion force of the spring 106. After the reflowable thermal fuse is installed on a circuit or panel and passed through a reflow oven, the restraining element may be blown by applying an arming current through the restraining element. This in turn arms the reflowable thermal fuse.

A spacer 110 may be placed on the substrate 102. The spacer 100 is an insulating material, such as a ceramic, polymeric, or glass, or a combination of thereof. For example, the spacer 100 may be made of a fiber or glass-reinforced epoxy. The spacer 100 includes an opening that forms a channel that allows the sliding contact 108 to slide under the conditions discussed above. The spacer 110 may have a height slightly greater than a height of the sliding contact 108 such that when the cover 112 is placed on the circuit protection device 100, the underside of the cover abuts with the spacer 110, allowing the sliding contact 108 to slide freely and avoiding any friction between the sliding contact 108 and the cover 112.

A flux 138 may be applied to the top PCB 114 near the location where the sliding contact 108 is soldered to the electrodes 124, 126 and the heater element 104. The flux 138 may be a thermoplastic flux or other material characterized by a viscosity of less than 150 centipoise, and a melting point less than the melting point of the solder holding the sliding contact 108 to the heater element 104 and electrodes 124, 126. The flux 138 may also be a material characterized by an acid number of at least 30. The flux 138 may be, for example, a carboxylic acid. As another example, the flux 138 may include a mixture of carboxylic acid or other like material with a wax, e.g. polyethylene wax. The ratio of carboxylic acid or other like material to polyethylene wax is selected to increase the melting point of the mixture, relative to the melting point of the carboxylic acid or other like material alone, closer to the melting point of the solder without exceeding the melting point of the solder.

After application of the flux 138, the flux 138 is heated to its melting point. The flux 138 melts and spreads over the adjacent area. FIG. 1, for example, shows the flux 138 before being melted. The melted flux may spread around the solder holding the sliding contact 108 to the heater element 104 and electrodes 124, 126, as well as over parts of the heater element 104 and electrodes 124, 126, such as parts of the heater element 104 and electrodes 124, 126 not covered by the solder. The melted flux may also spread over parts of the electrode 128. The melted flux is then cooled, forming a film around the solder and over other parts over which the melted flux spread.

During operation after the circuit protection device 100 is armed, the flux 138 will melt before the solder holding the sliding contact 108 in place will melt in that the flux 138 is a material characterized by a melting point less than that of the solder. In other words, when an activation condition is detected and the solder melts, allowing the sliding contact 108 to slide, the flux 138 will have already melted as well. The melted flux 138 allows the sliding contact to smoothly slide away from the heater element 104 and electrodes 124, 126 without dragging the melted solder. Solder dragged by the sliding contact 108 can result in the solder bridging the sliding contact 108 and heater element 104 and electrodes 124, 126, resulting in an electrical connection between the heater element 104 and electrodes 124, 126 even after the circuit is intended to be open. As noted, the flux 138 described herein allows the sliding contact 108 to slide without dragging the solder and causing the bridging effect without interfering with the normal operation of the device 100.

Described below is an exemplary process for assembling the circuit protection device 100. The substrate 102 may be fabricated by a PCB panel process, where circuit board pads form primary terminals, and plated vias make the connection from these terminals to surface mount pads. Slots may be cut using known drill and router processes. As an alternative, discrete, injection-molded parts with terminals that are insert-molded, or installed in a post-molding operation, may be used.

After the substrate 102 is fabricated and patterned, the heater element 104 may be installed in the substrate 102, such as by soldering the bottom of the heater element 104 to the substrate 102. The spring element 106 is inserted into the channel 120. The sliding contact 108 is inserted and slid to place the spring element 106 in a compressed state between the cantilever 122 and a side of the channel 120. The sliding contact 108 is soldered to the heater element 104 and the electrodes 124, 126.

The restraining element is attached to the sliding contact 108 on one end, and to the electrode 128 on the other end. Alternatively, one end of the restraining element may be attached to the sliding contact 108 before the sliding contact is soldered to the heater element 104 and electrodes 124, 126. In this example, the other end of the restraining element is attached to the electrode 128 after soldering of the sliding contact 108. The restraining element may be attached by resistance welding, laser welding, or by other known welding techniques.

The flux 138 is applied to the top PCB 114 and then heated to the flux's melting point. The melted flux 138 spreads out over the heater element 104 and electrodes 124, 126. The melted flux 138 is then cooled, forming a film over the heater element 104 and electrodes 124, 126 and adjacent areas. The film may be located around the solder connection between the sliding contact 108 and heater element 104 and electrodes 124, 126. The flux 138 is applied and melted after the solder connection has been made between the sliding contact 108 and the heater element 104 and electrodes 124, 126, as well as after attachment of the restraining element which holds the sliding contact 108 in place before the circuit device 100 is armed. In this manner, if while heating and melting the flux 138 the temperature reaches the melting point of the solder, the restraining element will hold the sliding contact 108 in place until the solder cools again.

The spacer 110 may then be placed on top of the substrate 102, the opening within the spacer having a width sufficient for the sliding contact 108 to fit within. The cover 112 may then be installed to keep the various parts in place.

Figure 2B:
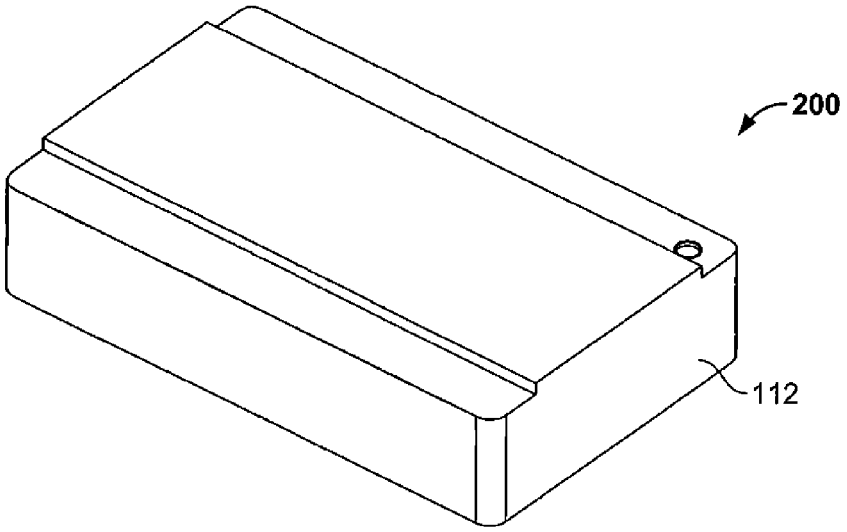
FIG. 2*b* is a top view the assembled circuit protection device shown in FIG. 2*a*.

FIGS. 2*a*-2*b* show bottom and top views, respectively, of an assembled circuit protection device 200. The bottom of the circuit protection device may include terminals 202, 204, 206, 208 that facilitate electrical connection of the electrodes 124, 126, 128 and the heater element 106, respectively, to external circuit board elements. In this manner the terminals 202, 204, 206, 208 may be utilized to mount the circuit protection device 200 to a surface of a circuit panel (not shown) and bring the heater element 106, electrodes 124, 126, 128 into electrical communication with circuitry outside of the device 200.

In order to achieve a low profile, the height of the circuit protection device 200 may be 1.5 mm or less. The width of the circuit protection device 200 may be 3.8 mm or less. The length of the circuit protection device 200 may be 6.0 mm or less. In one embodiment, the circuit protection device may be 6.0 mm×3.8 mm×1.5 mm. Due to the expansion force of the spring element being parallel to the plane of the substrate surface, which results in the sliding contact also sliding parallel to the plane of the substrate, a substantially thin circuit protection device 200 is achieved.

FIGS. 3*a*-3*b* show a circuit protection device 300 with the sliding contact 302 in the closed and open positions, respectively. In the closed position the sliding contact 302 bridges and provides an electrical connection between the electrodes 304, 306 and the heater element 308. In the open position, when the solder holding the sliding contact 302 to the electrodes 304, 306 and heater element 308 melts, the force of an expanding spring element pushes the sliding contact 302 down the channel 310 in the substrate 312, severing the electrical connection between the electrodes 304, 306 and heater element 308. As discussed above, the circuit protection device 300 is a three-function reflowable thermal fuse that is configured to open under three conditions: over current, over temperature, and controlled activation.

FIG. 3*a* also shows the restraining element 314 discussed above. The restraining element 314 may be a welded, fusible restraining wire that holds the sliding contact 302 in place during reflow. In particular, the restraining element 314 is adapted to secure the sliding contact 302 in a state that prevents it from sliding down the channel 310 during reflow. For example, the restraining element 314 may enable keeping the spring element in a compressed state even with the solder or other material holding the sliding contact 302 to the electrodes 304, 306 and heater element 308 melts, thereby preventing the spring element from expanding and pushing the sliding contact 302 down the channel 310.

The restraining element 314 may made of a material capable of conducting electricity. For example, the restraining element 314 may be made of copper, stainless steel, or an alloy. The diameter of the restraining element 314 may be sized so as to enable blowing the restraining element 314 with an arming current. The restraining element 314 is blown, such as by running a current through the restraining element 314, after the device 300 is installed. In other words, sourcing a sufficiently high current, or arming current, through the restraining element 314 may cause the restraining element 314 to open. In one embodiment, the arming current may be about 2 Amperes. However, it will be understood that the restraining element 314 may be increased or decrease in diameter, and/or another dimension, allowing for higher or lower arming currents.

To facilitate application of an arming current, a first end 314*a* and second end 314*b* of the restraining element 314 may be in electrical communication with various pads disposed about the housing. The first end 314*a* may be connected to the electrode 316, which corresponds to the electrode 128 in the embodiment of FIGS. 1-2. Referring to the embodiment of FIGS. 1-2, the electrode 316 (or 128) is in electrical communication with the terminal 206. The second end 314*b* may be connected to the sliding contact 302. The arming current may be supplied to the electrode 316 through terminal 206.

FIGS. 3*a*-3*b* also shows a flux 318, such as the flux 138 described above with respect to FIG. 1, applied to the circuit protection device 300. In particular, FIG. 3*a* shows the flux 318 positioned below the sliding contact 302, while FIG. 3*b* shows that the flux 318 is positioned above the heater element 308 and electrodes 304, 306.

Described below is an exemplary process for installing the three-function reflowable circuit protection devices described herein. The circuit protection device is placed on a panel. Solder paste may be printed on a circuit board before the circuit protection device is positioned. The panel, with the circuit protection device, is then placed into a reflow oven which causes the solder on the pads to melt. After reflowing, the panel is allowed to cool.

An arming current is run through pins of the circuit protection device so as to blow the restraining element. Referring to FIG. 2, sufficient current, for example, 2 Amperes, may be applied to the terminal 206, which is electrically connected to the restraining element, so as to blow the restraining element and allow the spring element to push the sliding contact in the open position under one of the three conditions described herein. Blowing the restraining element places the circuit protection device in an armed state.

Figure 4:
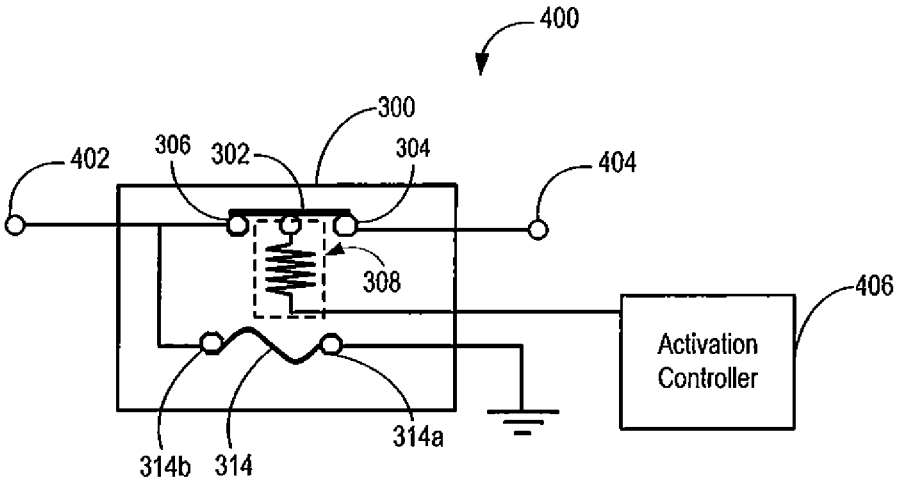
FIG. 4 is a schematic representation of an exemplary battery pack circuit to be protected by a circuit protection device before the restraining element is blown.
Figure 5:
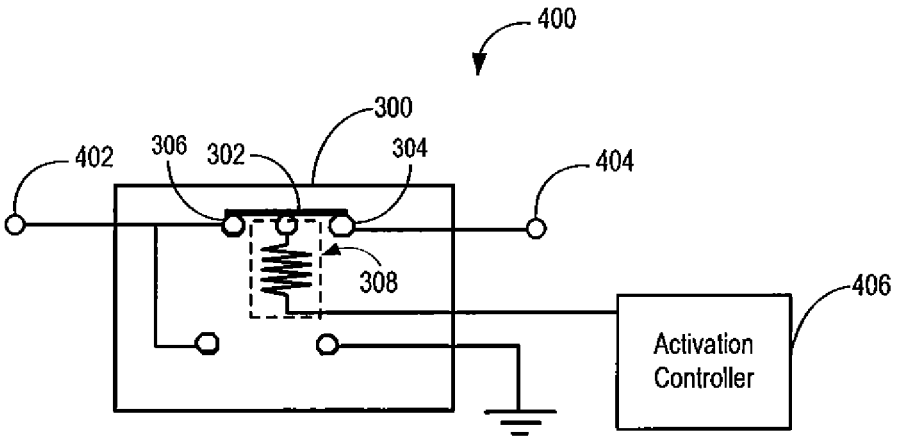
FIG. 5 is a schematic representation of the circuit of FIG. 4 with the restraining element blown and the sliding contact in the closed position.
Figure 6:
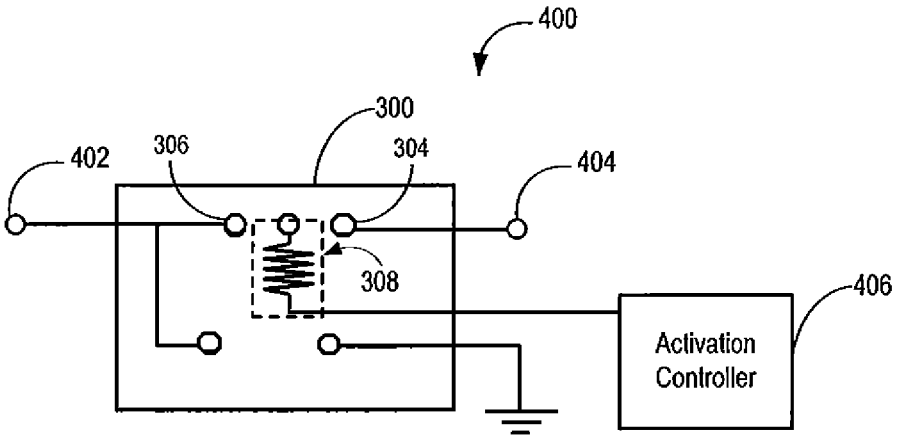
FIG. 6 is a schematic representation of the circuit of FIG. 5 with the sliding contact in the open position.

FIGS. 4-6 are a schematic representation of an exemplary battery pack circuit 400 to be protected by a circuit protection device. In the example shown in FIGS. 4-6, the circuit 400 utilizes the circuit protection device 300 of FIG. 3. For the sake of explanation, the circuit protection device 300 can be positioned in series with two terminals 402, 404 connected to circuit components to be protected, such as one or more FETs. It will be understood that the circuit protection device 300 may be used in other circuit configurations. The heater element 308 is electrically connected to an activation controller 406.

FIG. 4 shows the circuit protection device 300 before the restraining element 314 is blown. FIG. 5 shows the circuit protection 300 after the restraining element 314 is blown. Further, in FIGS. 4-5 the sliding contact 302 is in the closed position, thus bridging and providing an electrical connected between electrode 304, electrode 306, and electrode 308 (i.e., the heater element). FIG. 6 shows the circuit protection device 300 in the open position in which the electrical connected between the electrodes 304, 306, 308 is severed, such as after a fault condition (over current or over temperature) is detected, or after an activation signal by the activation controller 406.

FIG. 7 shows another embodiment for the substrate 700 of a three-function circuit protection device. In this embodiment utilizes an embedded resistor concept used in PCB construction. The substrate 700 includes a top PCB layer 702 and a bottom PCB layer 704. The top PCB layer 702 includes pads 706, 708 for electrical connection to patterned electrodes 710, 712, respectively, in the bottom PCB layer. The top PCB layer 702 also includes a via connection 714 to the heater element 716 that is laid up into the substrate 700 during a PCB process. In this example, the heater element 716 is a thin-film resistor or other heating device. With the film in this embodiment, the resistance path is transverse to the plane of the film. FIG. 7 also shows a flux 718 applied above the substrate 700, in particular, above the electrodes 706, 708 and above the contact pad 720 electrically connected with the heater element 716 via the via connection 714.

Figure 8:
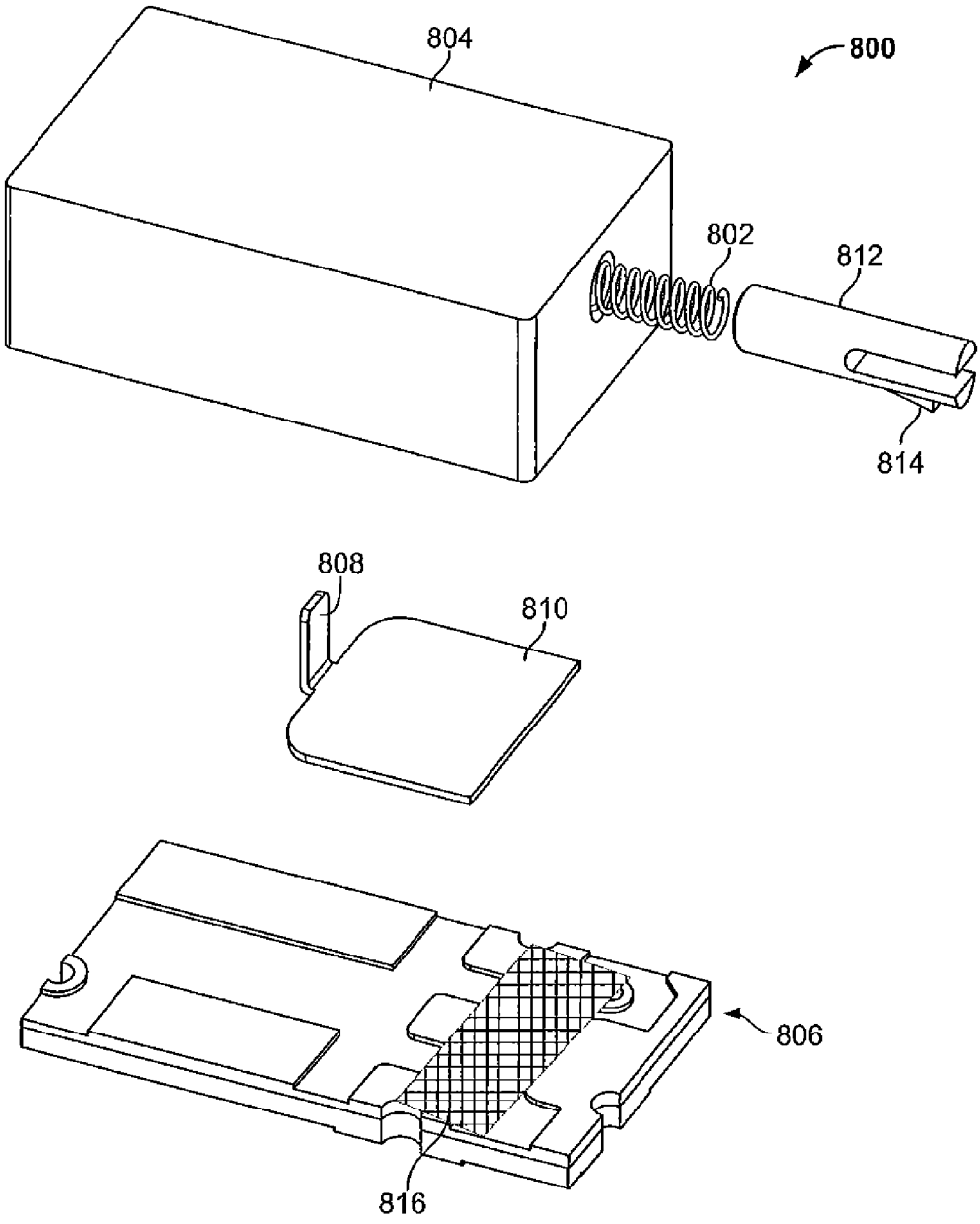
FIG. 8 is top view of another embodiment of a three-function reflowable circuit protection device.
Figure 9:
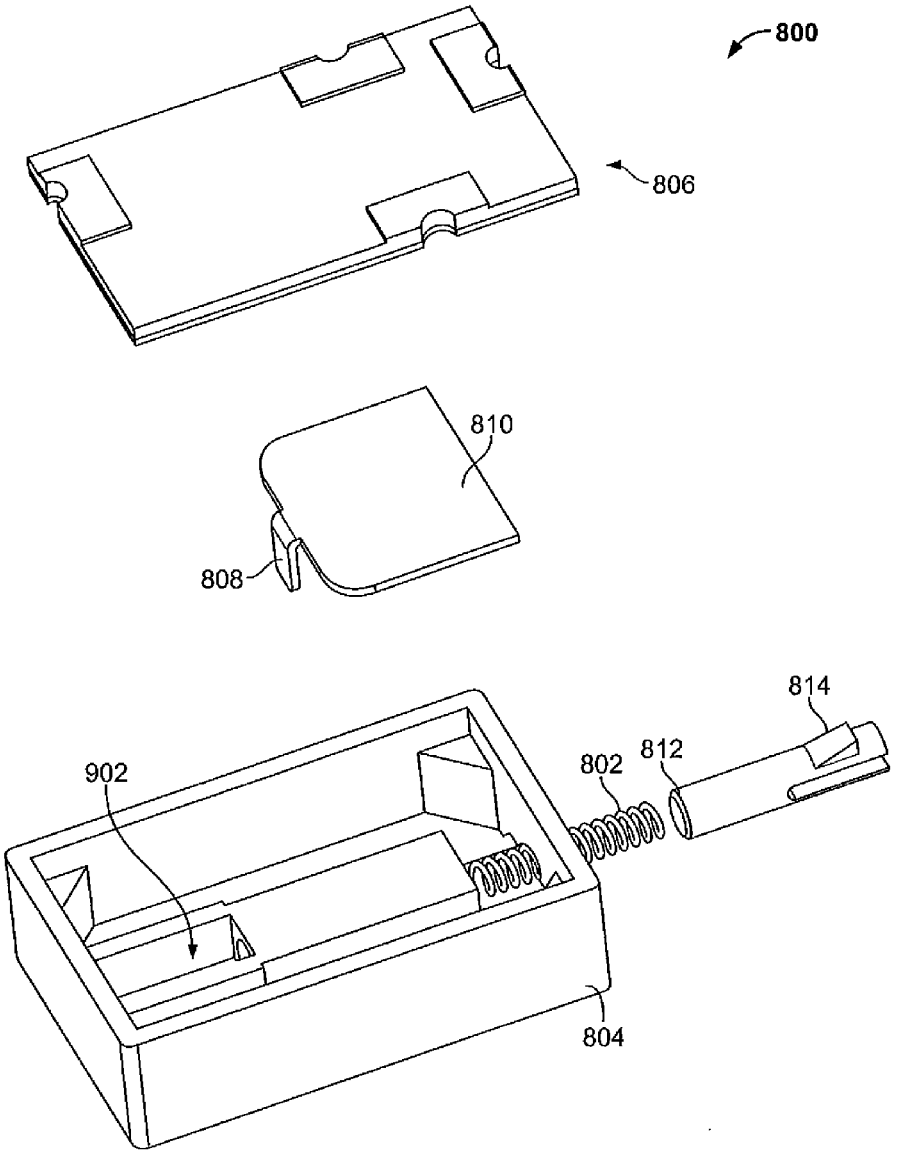
FIG. 9 is bottom view of the three-function reflowable circuit protection device shown in FIG. 8.

FIGS. 8-9 show top and bottom views, respectively, of another embodiment of a three-function reflowable circuit protection device 800. In the circuit protection device 800, the spring element 802 is located in the cover 804 instead of within the substrate 806. The cantilever portion 808 of the sliding contact 810 extends up into the cover 804 instead of down into an opening in the substrate 806. The substrate 806 in FIGS. 8-9 need not be patterned to include an opening that receives the cantilever portion 808 of the sliding contact 810. The substrate 806 includes a flux 816 applied thereon, such as the flux 138 described above with respect to FIG. 1.

The underside of the cover 804 (shown in FIG. 9) includes a depression, or channel 902, into which the cantilever portion 808 may be inserted, and through which the cantilever portion 808 may slide when the solder holding the sliding contact 810 to the electrodes of the substrate 806 melts.

The spring element 802 may be installed into the cover 804 through a side of the cover 804. A cap 812 may then be inserted into the side of the cover 804 to hold one end of the spring element 802 in place such that when the spring element 802 expands under of the activation conditions described herein, the resulting force will push the cantilever portion 808 down the channel 902. The cap 812 includes a protrusion 814 that is tapered on one end and normal to the length of the cap 812 on the other end. In this manner, the cap 812 may be inserted into a hole on the side of the cover 804 with a snap-fit connection. It will be understood that other methods may be used to insert the spring element 802 into the cover 804.

While the three-function reflowable circuit protection device has been described with reference to certain embodiments, it will be understood by those skilled in the art that various changes may be made and equivalents may be substituted without departing from the scope of the claims of the application. In addition, many modifications may be made to adapt a particular situation or material to the teachings without departing from its scope. Therefore, it is intended that the three-function reflowable circuit protection device is not to be limited to the particular embodiments disclosed, but to any embodiments that fall within the scope of the claims.

FIGS. 10-16 show other exemplary reflowable thermal fuses including a flux. Generally, the reflowable thermal fuses include a conduction element through which a load current flows, and an elastic element adapted to apply a force on the conduction element. In some embodiments, the conduction element incorporates a sensing element. When the temperature of the sensing element exceeds a threshold, the sensing element loses its resilience and becomes susceptible to deformation and/or breakage via the force on the conduction element applied by the elastic element. Eventually, the conduction element mechanically opens under the force, resulting in an open circuit condition. In other embodiments, the sensing element and the conduction element are separate and the sensing element acts to keep the conduction element in a low resistance state.

During a reflow process, the sensing element may lose its resilience. To prevent the force applied by the elastic element from opening the conduction element during installation, a restraining element may be utilized to maintain the elastic element in a state whereby the elastic element does not apply force on the conduction element. After the reflowable thermal fuse is installed on a panel and passed through a reflow oven, the restraining element may be blown by applying an activating current through the restraining element. This in turn activates the reflowable thermal fuse.

Figure 10:
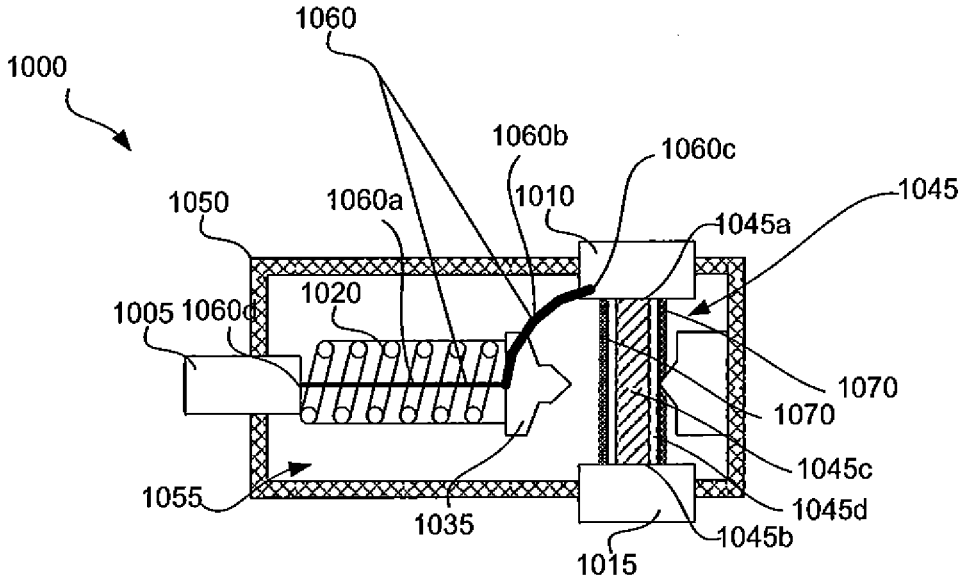
FIG. 10 is a cross sectional view of a first embodiment of another exemplary reflowable thermal fuse.

FIG. 10 is a cross sectional view of a first embodiment of a reflowable thermal fuse 1000. The reflowable thermal fuse 1000 includes a conduction element 1045, an elastic element 1020, and a restraining element 1060*a*. In some embodiments, the conduction element 1045, elastic element 1020, and restraining element 1060 may be disposed within a housing 1050 that includes first, second, and third pads (1010, 1015, and 1005) disposed around the housing 1050. In other embodiments, the conduction element 1045, elastic element 1020, and restraining element 1060 may be disposed on a substrate, and/or on a circuit board.

The first, second, and third pads (1010, 1015, and 1005) may be utilized to mount the reflowable thermal fuse 1000 to a circuit panel (not shown) and bring the conduction element 1045 and/or the restraining element 1060 into electrical communication with circuitry outside of the housing 1050.

The conduction element 1045 includes first and second ends 1045*a* and 1045*b* that may be in electrical communication with the first and second pads 1010 and 1015, respectively. The conduction element also includes a sensor 1045*c*. The sensor 1045*c* may be made of any conductive or non-conductive material that has a relatively low melting point and/or loses resilience at a specified temperature, such as solder or plastic. In some embodiments, the sensor 1045*c* is disposed inside of an outer tube 1045*d* adapted to contain the sensor 1045*c* when the sensor 1045*c* loses its resilience. For example, the outer tube 1045*d* may prevent the sensor 1045*c* from freely moving about the inside of the housing 1050 when the sensor 1045*c* melts. In another embodiment, the sensing element may be contained by surface tension. In an operation of the reflowable thermal fuse, the load current flows through the conduction element 1045. For example, the load current from a power supply may flow through the reflowable thermal fuse to other circuitry. In some embodiments, the current that flows through conduction element 1045 flows primarily through the sensor 1045*c*. In other embodiments, the primary current does not flow through the sensor 1045*c*.

In yet other embodiments, the conduction element and sensing element may be separate, but the sensing element may act to keep the conduction element in the low resistance state. For example, the conduction element may include a set of "dry" (unsoldered) contacts that are held together by a sensor comprised of a mass of discrete melting organic material, such as 4-methylumbelliferone as disclosed in U.S. Pat. No. 4,514,718.

Figure 13A:
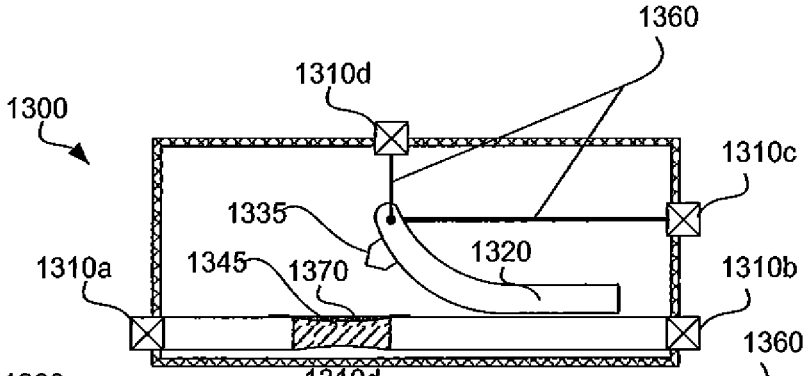
FIG. 13*a* is a cross sectional view of a first embodiment of a reflowable thermal fuse that utilizes four pads.

The elastic element 1020 corresponds to any material suitably adapted to apply force on the conduction element 1045. In one embodiment, the elastic element corresponds to a coil spring, as shown in FIG. 10. In another embodiment, the elastic element 1020 corresponds to a leaf spring 1320 as shown in FIG. 13*a*. The Applicant contemplates that the elastic element 1020 may be made of other materials and/or structures known to those of skill in the art. For example, the elastic element 1020 may correspond to a sponge like material, such as silicone rubber foam. The elastic element 1020 may be made of a conductive material, such as copper or stainless steel, or a non-conductive material, such as plastic or fiber reinforced plastic composite. Other materials and structures may be utilized.

In some embodiments, the elastic element 1020 may include a tapered tip, such as the tip 1035 shown in FIG. 10 or the tip 1335 shown in FIG. 13*a*. The tapered tip may be utilized to concentrate the force applied by the elastic element 1020 in the tip. This may enable severing the sensor 1045*c* during a fault condition as described below. In this case, the sensor 1045*c* and the conduction element 1045 are one in the same. It is the severing of the conduction element 1045 that accomplishes the fusing function.

The restraining element 1060 is adapted to secure the elastic element 1020 in a state that prevents the elastic element 1020 from applying force on the conduction element 1045. For example, the restraining element 1060 may enable keeping the elastic element 1020 in either an expanded or compressed state, thereby preventing the elastic element from applying force against the conduction element 1045. The restraining element 1060 may correspond to any material capable of conducting electricity. For example, the restraining element 1060 may be made of copper, stainless steel, or an alloy. The diameter of the restraining element 1060 may be sized so as to enable blowing the restraining element 1060 with an activating current. In other words, sourcing a sufficiently high current, or activating current, through the restraining element 1060 may cause the restraining element 1060 to open. In one embodiment, the activating current may be about 1 A. However, Applicants contemplate that the restraining element 1060 may be increased or decrease in diameter, and/or another dimension, allowing for higher or lower activating currents.

To facilitate application of an activating current, a first end 1060*c* and second end 1060*d* of the restraining element 1060 may be in electrical communication with various pads disposed about the housing. In the embodiment of FIG. 10, the first end 1060*c* and second end 1060*c* may be in electrical communication with the first pad 1010 and third pad 1005, respectively. The activating current may then be applied across the first pad 1010 and third pad 1005.

In some embodiments, the restraining element 1060 may include a first region 1060*a* adapted to open when the activating current flows through the restraining element 1060 and a second region 1060*b* adapted to not open when the activating current flows through the restraining element 1060. For example, the first region 1060*a* may be of a smaller diameter than the second region 1060*b*. This may enable controlling the location where the restraining element 1060 opens, which may be advantageous. For example, referring to FIG. 10, the first region 1060*a* of the restraining element 1060 may extend along the length of the elastic element 1020 and the second region 1060*b* may be coupled to the tip 1035 of the elastic element 1020 and a first pad 1010. Providing the two regions in the restraining element 1060 may prevent the restraining element 1060 from opening in a location within the housing 1050 where the restraining element 1060 may interfere with the operation of the reflowable thermal fuse 1000.

A flux 1070 may be applied to conduction element 1045. The flux 1070 may be a thermoplastic flux or other material characterized by a viscosity of less than 150 centipoise, and a melting point less than the melting point of the sensor 1045*c*. The flux 1070 may also be a material characterized by an acid number of at least 30. The flux 1070 may be, for example, a carboxylic acid. As another example, the flux 1070 may include a mixture of carboxylic acid or other like material with a polyethylene wax. The ratio of carboxylic acid or other like material to polyethylene wax is selected to increase the melting point of the mixture, relative to the melting point of the carboxylic acid or other like material alone, closer to the melting point of the sensor 1045*c* without exceeding the melting point of the sensor 1045*c*. FIG. 10 shows the flux 1070 on either side of the conduction element 1045; it will be understood, that FIG. 10 is a cross section and the flux 1070 may surround all or a portion of the conduction element 1070. The flux 1070 may also be applied on a side of the conduction element 1045 that faces the elastic element 1020.

After application of the flux 1070 to the conduction element 1045, the flux 1070 is heated to at least its melting point. The flux 1070 melts and spreads over the adjacent area. The melted flux is then cooled, forming a film around the conduction element 1045 and over other parts over which the melted flux spread.

During operation after the fuse 1000 is armed, the flux 1070 will melt before the sensor 1045*c* will melt in that the flux 1070 is a material characterized by a melting point less than that of the solder. In other words, when an fault condition is detected and the sensor 1045*c* melts, allowing the tip 1035 of the elastic element 1020 to penetrate the conduction element 1045, the flux 1070 will have already melted.

Figure 11A:
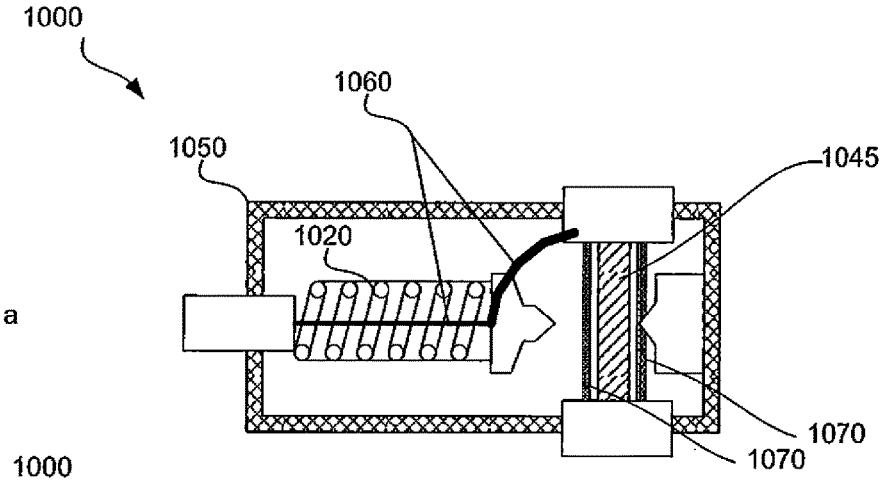
FIG. 11*a* is a cross sectional view of the first embodiment of the reflowable thermal fuse in an installation state.
Figure 11B:
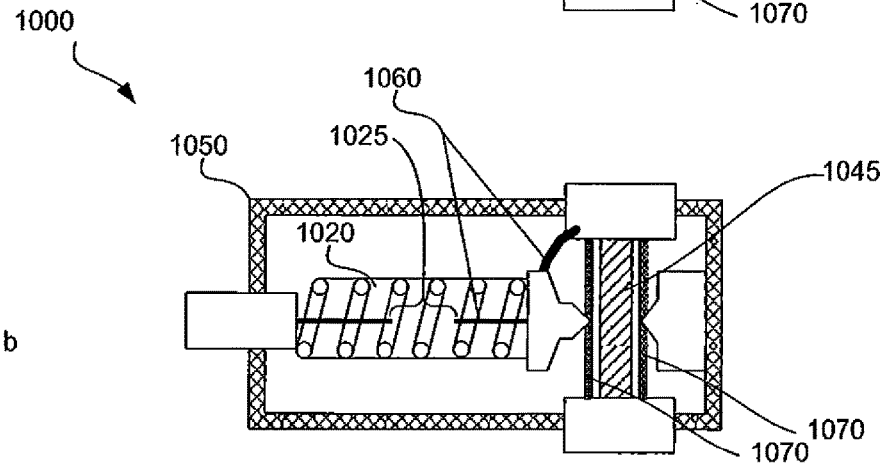
FIG. 11*b* is a cross sectional view of the first embodiment of the reflowable thermal fuse in an activated state.
Figure 11C:
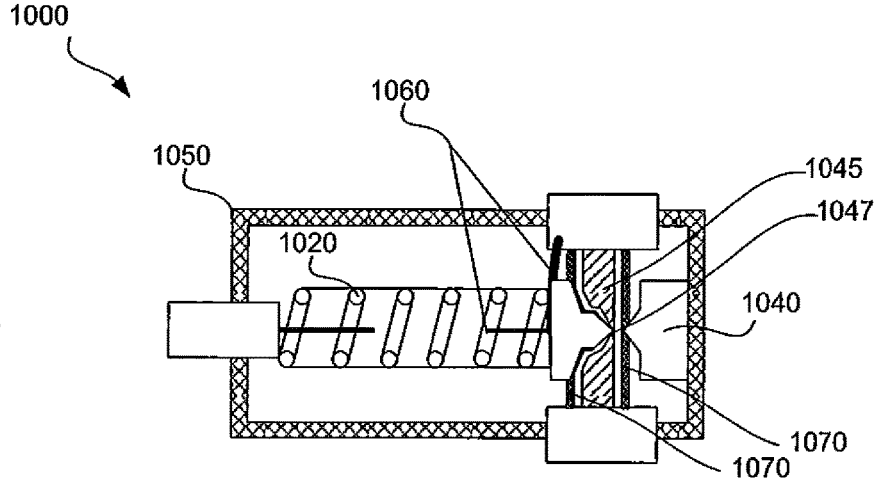
FIG. 11*c* is a cross sectional view of the first embodiment of the reflowable thermal fuse during a fault condition.

FIG. 11*a*-FIG. 11*c* illustrate various states of an embodiment of a reflowable thermal fuse. In FIG. 11*a*, the reflowable thermal fuse is in an installation state. In this state, the restraining element 1060 is utilized to prevent the elastic element 1020 from applying force on the conduction element 1045. While in this state, the reflowable thermal fuse 1000 may be installed on a circuit panel via a reflow oven. During the reflow process, the temperature of the reflowable thermal fuse 1000 along with the rest of the panel is increased until the solder connecting the reflowable thermal fuse to the panel melts. At this temperature, the sensor 1045*c* of the conduction element 1045 may lose resilience and become susceptible to deformation and or breakage. As discussed earlier, the sensor 1045*c* may be surrounded by an outer tube, as shown in FIG. 10. This may enable constraining the movement of the sensor 1045*c* during the reflow process. Alternatively, the sensor 1045*c* may be held in place via surface tension. After the reflowable thermal fuse 1000 is soldered to the panel, the panel may be cooled off to allow the solder to solidify.

FIGS. 11*a*-11*c* also show the flux 1070 applied to the conduction element 1045. The flux 1070 is applied and melted after the after attachment of the restraining element 1060 which holds the elastic element 1020 in place before the fuse 1000 is armed. FIG. 11*a* shows the fuse 1000 before it is armed, i.e., before the restraining element 1060 is blown. In this manner, if while heating and melting the flux 1070 the temperature reaches the melting point of the sensor 1045*c*, the restraining element will hold the elastic element 1020 in place until the sensor 1045*c* cools again, preventing the tip 1035 of the elastic element 1020 from penetrating the conduction element 1045 before the fuse has been armed.

FIG. 11*b* illustrates an activated, or armed, reflowable thermal fuse 1000. The reflowable thermal fuse 1000 may be activated after the reflow process above by passing an activating current through the restraining element 1060. This causes an opening 1025 in the restraining element 1060 to form, thereby releasing the elastic element 1020 so that it may apply force on the conduction and sensing element 1045. The activating current may be applied to the restraining element 1060 via the pads disposed around the housing 1050 of the reflowable thermal fuse 1000.

FIG. 11*c* illustrates a reflowable thermal fuse 1000 during a fault condition. In this state, the reflowable thermal fuse 1000 has been previously activated, or armed, as described above. The ambient temperature surrounding the reflowable thermal fuse may reach a temperature, such as 200 degrees Celsius, that causes the flux 1070 and sensor 1045*c* to lose resilience and/or become susceptible to deformation. After this occurs, force applied via the elastic element 1020 causes an opening 1047 to form in the sensor 1045*c*, thus preventing electrical current from flowing through the sensor 1045*c* and therefore the conduction element 1045.

Figure 12:
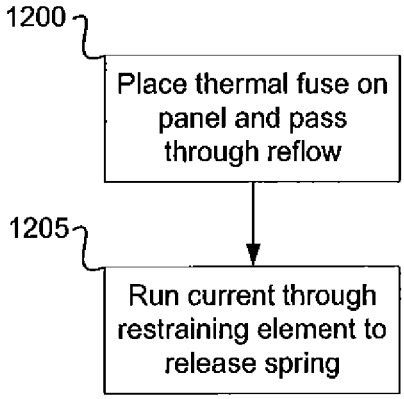
FIG. 12 is a flow diagram for installing a reflowable thermal fuse on a panel and activating the reflowable thermal fuse.

FIG. 12 is a flow diagram for installing a reflowable thermal fuse on a panel. At block 1200, the reflowable thermal fuse is placed on a panel. For example, a reflowable thermal fuse, such as the reflowable thermal fuse 1000 is placed on a panel. The reflowable thermal fuse 1000 may be in the installation state as shown FIG. 11*a*. Solder paste may have been previously applied to the pad locations on the panel associated with the reflowable thermal fuse 1000 via a masking process. The panel, with the reflowable thermal fuse, is then placed into a reflow oven which causes the solder on the pads to melt. After reflowing, the panel is allowed to cool.

At block 1205, an activating current is run through pins of the reflowable thermal fuse so as to blow the restraining element. For example, referring to FIG. 10, 1 Ampere of current may be run through the first and third pads 1010 and 1005 so as to blow the restraining element 1060 and allow the elastic element 1020 to apply force on the conduction element 1045. This operation places the reflowable thermal fuse in an activated state, as shown in FIG. 11*b*. Subsequent application of excessive heat to the reflowable thermal fuse may cause the sensor 1045*c* to lose its resilience and/or become susceptible to deformation and/or breakage under the force applied by the elastic element.

As can be seen from the description above, the reflowable thermal fuse overcomes the problems associated with placement of thermal fuses on panels via reflow ovens. The restraining element enables securing the conduction element during the reflow process. Application of an activation current then activates the reflowable thermal fuse. Then during a subsequent fault condition the conduction element is opened.

Figure 13B:
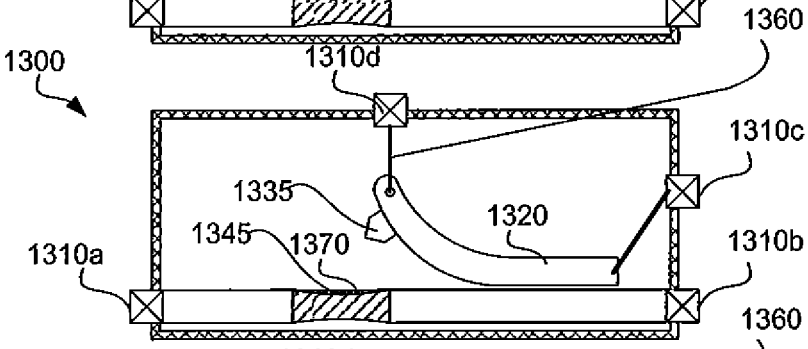
FIG. 13*b* is a cross sectional view of a second embodiment of a reflowable thermal fuse that utilizes four pads.
Figure 13C:
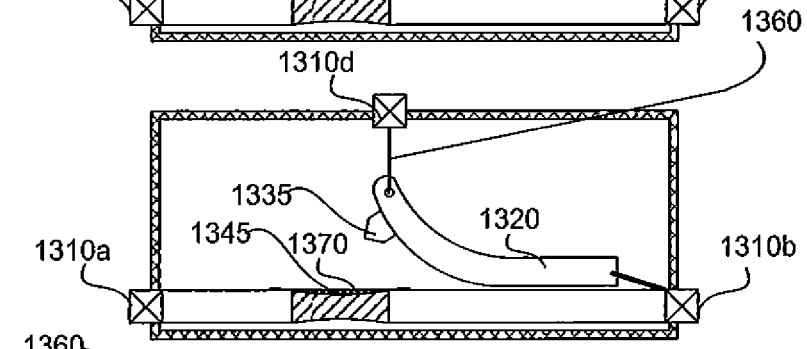
FIG. 13*c* is a cross sectional view of an embodiment of a reflowable thermal fuse that utilizes three pads.
Figure 13D:
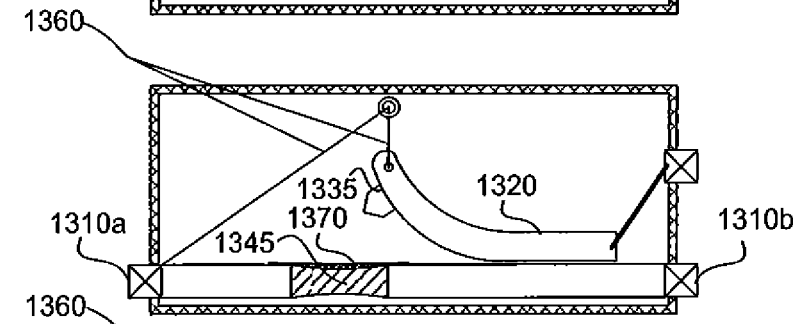
FIG. 13*d* is a cross sectional view of a second embodiment of a reflowable thermal fuse that utilizes three pads.
Figure 13E:
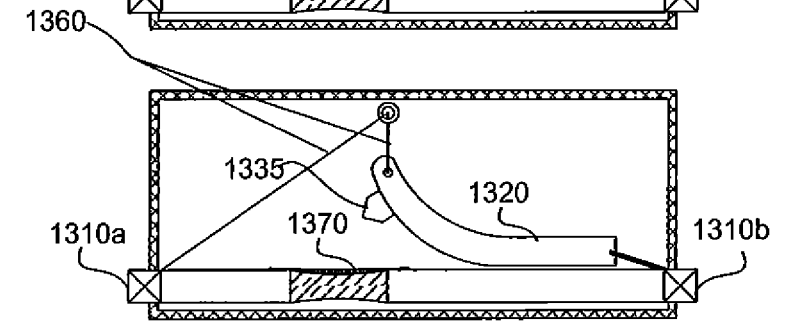
FIG. 13*e* is a cross sectional view of an embodiment of a reflowable thermal fuse that utilizes two pads.

While the reflowable thermal fuse and the method for using the reflowable thermal fuse have been described with reference to certain embodiments, it will be understood by those skilled in the art that various changes may be made and equivalents may be substituted without departing from the scope of the claims of the application. For example, referring to FIG. 13*a*, four pads (1310*a*, 1310*d*, 1310*c*, and 1310*b*) may be utilized instead of three. In this case, the activating current may be passed through a first and second pad (1310*d* and 1310*c*) to activate the reflowable thermal fuse 1300. This results in the tip 1335 coming into contact with the conduction element 1345. As shown in FIG. 13*b*, the elastic element 1320 may be utilized as a conductor and may be in electrical communication with a pad 1310*c* so that the activating current flows through the elastic element 1320 to the restraining wire 1360 and opens the restraining wire 1360. As shown in FIG. 13*c* and FIG. 13*d*, three pads (1310*a*, 1310*d*, and 1310*b*) may be utilized and the activating current may flow through the elastic element 1320. As shown in FIG. 13*e*, the same two pads (1310*a*, 1310*b*) through which the load current flows may be utilized to blow the restraining wire.

As shown in FIGS. 13*a*-13*e*, a flux 1370 is applied to the conduction element 1345. The flux 1370 may be a material as discussed above with respect to the flux 138 or flux 1070. As in previous examples, the flux 1370 is applied to the conduction element 1345, heated, and then cooled after application of the restraining element 1360 and before applying the activation current to the restraining element.

Figure 14A:
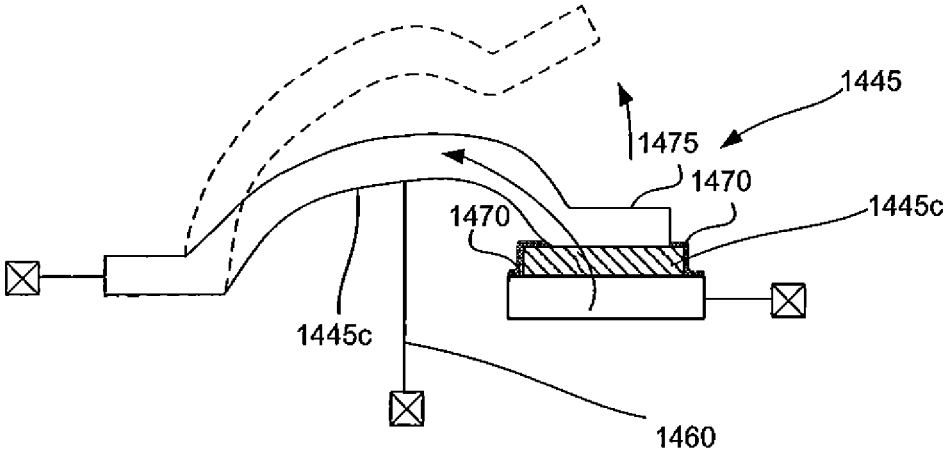
FIG. 14*a* is a first embodiment of a reflowable thermal fuse that utilizes a spring bar.
Figure 14B:
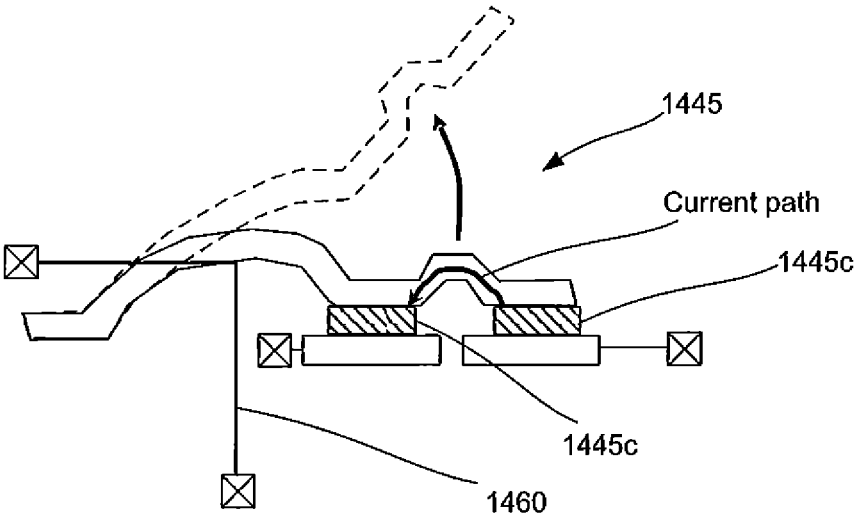
FIG. 14*b* is a second embodiment of a reflowable thermal fuse that utilizes a spring bar.

FIG. 14*a* and FIG. 14*b* are yet other alternatives embodiments contemplated by the Applicant. In FIG. 14*a*, a spring-bar 1445 may be utilized. The spring-bar may be utilized as the conduction element 1445 of the thermal fuse through which a load current flows. The conduction element 1445 may include a portion that is in elastic tension, and also a sensor 1445*c*. A restraining element 1460 may be provided for holding the conduction element 1445 in place during a reflow process. During normal operations, a load current may flow through the conduction element 1445. After activation, or blowing of the restraining element 1460, the conduction element 1445 is held in place via the sensor 1445*c*. During a fault condition, excessive heat causes the sensor 1445*c* to lose its ability to hold the conduction element 1445 in place and the conduction element 1445 subsequently opens as shown.

As shown in FIG. 14*a*, a flux 1470 is applied to the sensor 1445*c*. The flux 1470 may be a material as discussed above with respect to the flux 138, flux 1070 or flux 1370. As in previous examples, the flux 1470 is applied to the sensor 1445*c*, heated, and then cooled after application of the restraining element 1460 and before applying the activation current to the restraining element. In one example, the flux 1470 may be applied to a top surface 1475 of the spring-bar 1445. Then, when heated and melted, the flux 1470 will flow down over the sensor 1445*c* and adjacent areas. When cooled, the flux 1470 forms a thin film over the sensor 1445*c* and adjacent areas as shown in FIG. 14*a*.

In FIG. 14*b*, a portion of the spring bar 1445 may correspond to a conduction element through which a load current flows under normal operating conditions as shown. As described above, once the thermal fuse is activated, subsequent application of excessive heat causes the sensor 1445*c* to lose its ability to hold the conduction element 1445 in place and the conduction element 1445 subsequently opens as shown.

Figure 15A:
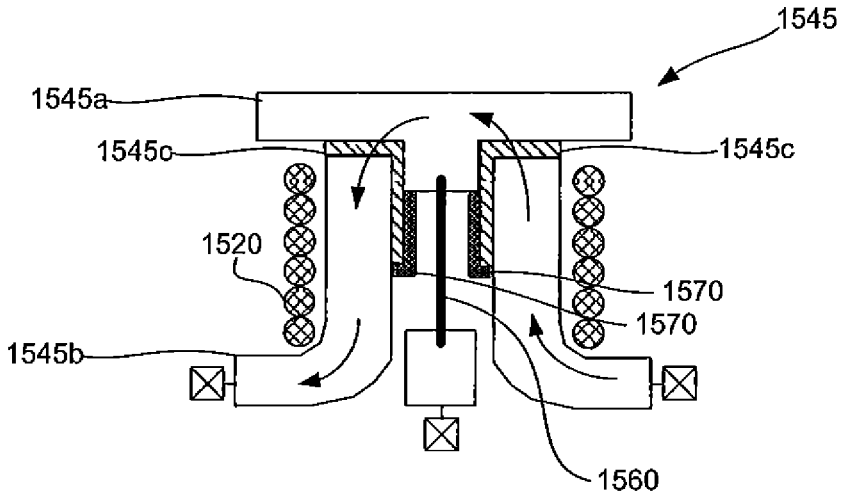
FIG. 15*a* is a cross-sectional view of yet another embodiment of a reflowable thermal fuse.
Figure 15B:
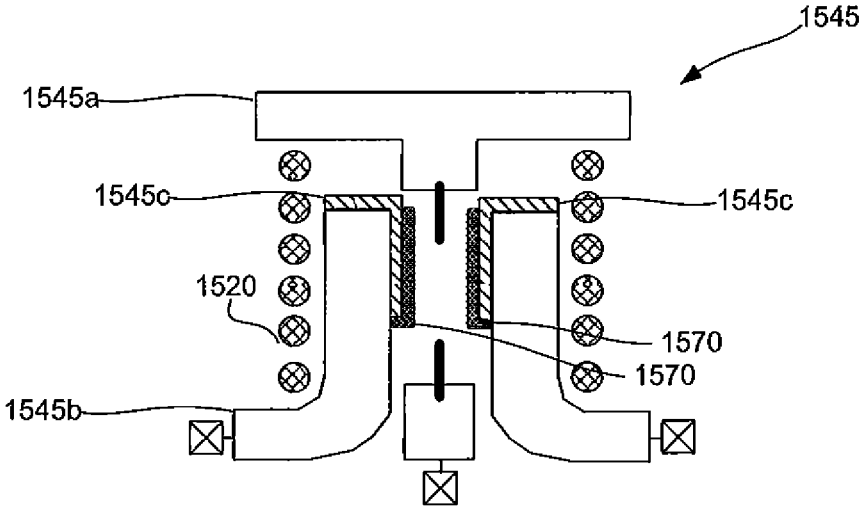
FIG. 15*b* is the reflowable thermal fuse of FIG. 15*a* after a fault condition has occurred.

FIG. 15*a* is a cross-sectional view of yet another embodiment of a reflowable thermal fuse. In FIG. 15*a*, the conduction element 1545 includes first and second portions 1545*a* and 1545*b*. A sensor 1545*c* is disposed between the two portions and enables current to flow between the first and second portions 1545*a* and 1545*b*. An elastic element 1520 that corresponds to a spring is rapped around the second portion 1545*b* of the conduction element 1545 and applies force between the first and second portions 1545*a* and 1545*b*. A restraining element 1560 is provided to keep the first and second portions 1545*a* and 1545*b* of the conduction element 1545 in place during reflow. An activation current is passed through the restraining element 1560 to blow the restraining element 1560. Subsequent application of excessive heat causes the sensor 1545*c* to lose its ability to hold the two portions of the conduction element 1545 in place, and the elastic element 1520 forces the two portions to move apart as shown in FIG. 15*b*. This in turn subsequently opens the conduction element 1545.

As shown in FIGS. 15*a*-5*b*, a flux 1570 is applied to the sensor 1545*c*. The flux 1570 may be a material as discussed above with respect to the flux 138, flux 1070, flux 1370 or flux 1470. As in previous examples, the flux 1570 is applied to the sensor 1545*c*, heated, and then cooled after application of the restraining element 1560 and before applying the activation current to the restraining element. The cooled flux 1570 forms a thin film over the sensor 1445*c*

Applicants contemplate that there may be instances where the reflowable thermal fuse described above cannot react fast enough to a particular type of fault condition. For example, the sensor may not lose its resilience fast enough to protect a circuit from a cascade failure. Therefore, in alternative embodiments a positive-temperature-coefficient (PTC) device, such as the PTC device disclosed in U.S. application Ser. No. 12/383,560, filed Mar. 24, 2009 and published as U.S. Publication No. 2010/0245027 A1, now U.S. Pat. No. 8,289,122, which is hereby incorporated by reference in its entirety, may be inserted in series with the conduction element to enable more rapid heating of the sensor due to the proximity of the PTC device to the sensor and $I^2R$ heating produced by the PTC device. Other heat producing devices, such as a conductive composite heater, that generate heat as a result of current flowing through the device, may be utilized in addition to or instead of the PTC device. In addition, the PTC device may provide overcurrent functionality that allows the fuse to become an overcurrent fuse, resulting in a permanent open.

Figure 16A:
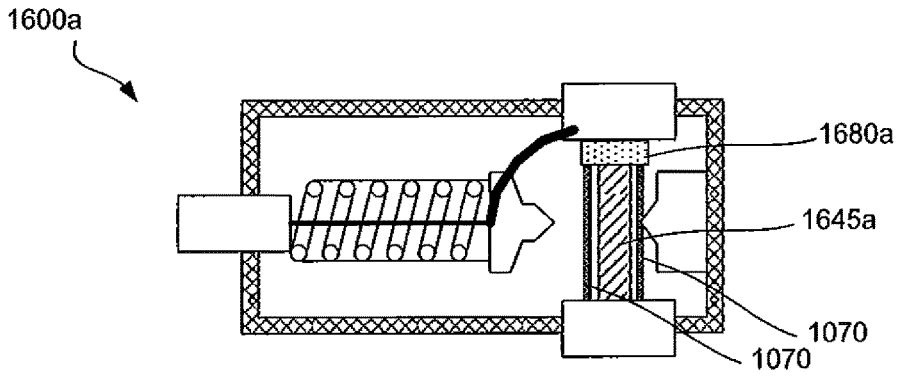
FIGS. 16*a*-16*e* illustrate various exemplary reflowable thermal fuse configurations that incorporate a heat producing device.
Figure 16B:
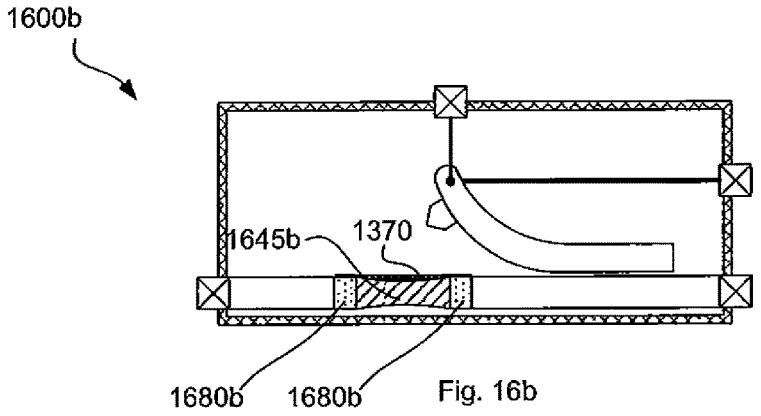
Figure 16C:
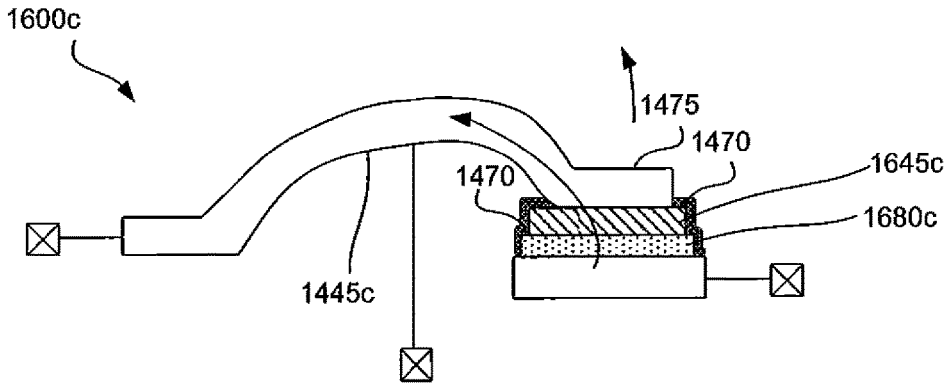
Figure 16D:
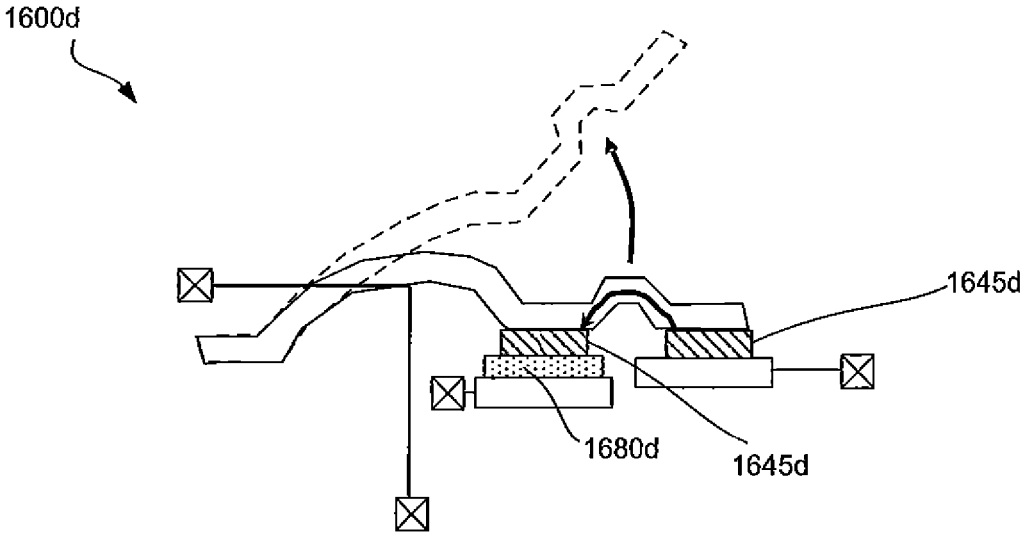
Figure 16E:
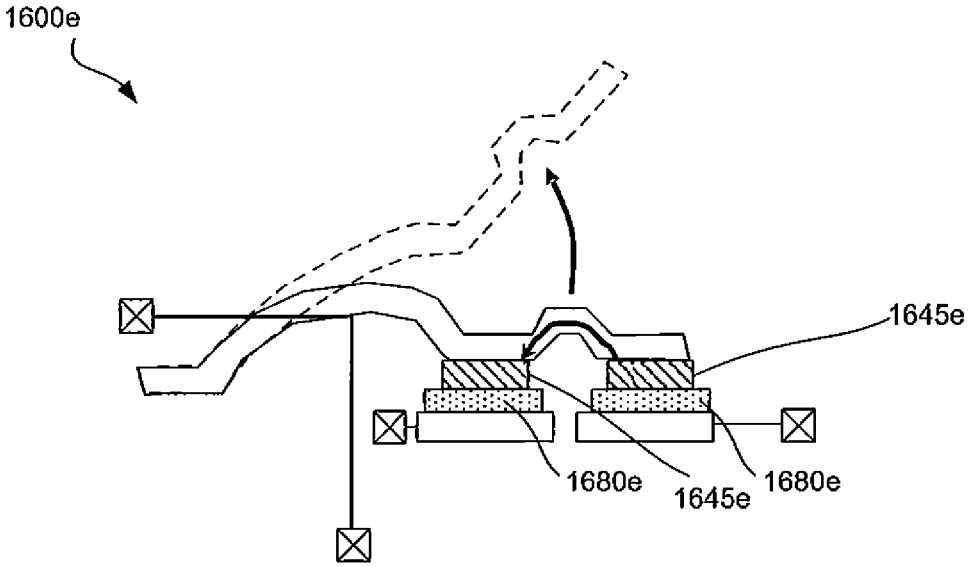

FIGS. 16*a*-16*e* illustrate various exemplary reflowable thermal fuse configurations 1600*a-e* that incorporate a heat producing device 1680*a-e* such as the PTC device described above. As shown, the heat producing device 1680*a-e* may be in electrical and/or mechanical communication with the conduction element 1645*a-e*. As shown in FIGS. 16*a*-16*c*, the flux 1070, 1370 and 1470 may be in contact with at least part of the heat producing device 1680*a*, 1680*b* and 1680*c*, respectively. Current may flow through the heat producing device 1680*a-e* and continue on through the conduction element 1645*a-e*. As the current flowing through the heat producing device 1680*a-e* increases, the resistance of the heat producing device may increase resulting in an increase in the temperature of the heat producing device 1680*a-e*. The increase in temperature may cause the conduction element to lose resilience more quickly resulting in an open circuit condition.

While the reflowable thermal fuses shown in FIGS. 10-17 and the method for using the reflowable thermal fuse have been described with reference to certain embodiments, it will be understood by those skilled in the art that various changes may be made and equivalents may be substituted without departing from the scope of the claims of the application. For example, one of ordinary skill will appreciate that the heat producing device described above may be adapted to work with any of the reflowable thermal fuse embodiments disclosed herein, or any equivalents thereof, so as to enhance the operating characteristics of the reflowable thermal fuse. In addition, many modifications may be made to adapt a particular situation or material to the teachings without departing from its scope. Therefore, it is intended that reflowable thermal fuse shown in FIGS. 10-17 and method for using the reflowable thermal fuse are not to be limited to the particular embodiments disclosed, but to any embodiments that fall within the scope of the claims.

FIGS. 18-22 show another exemplary reflowable thermal fuse that include a conduction element through which a load current flows, a positive-temperature-coefficient (PTC) device, and a restraining element. The restraining element is utilized to keep the conduction element in a closed state during a reflow process.

Under normal operating conditions, current that flows into the reflowable thermal fuse shown in FIGS. 18-22 flows primarily through the PTC device and the conduction element. Some current also flows through the restraining element. During a high temperature and/or high current fault condition, the resistance of the PTC device increases. This in turn causes current flowing through the PTC device to be diverted to the restraining element until the restraining element mechanically opens. After the restraining element opens, the conduction element is allowed to enter an open state. In some embodiments, a high ambient temperature around the reflowable thermal fuse causes the sensor to lose resilience and/or melt. This in turn enables the conduction element to enter the open state. In other embodiments, current flowing into the reflowable thermal fuse and through the PTC device causes the PTC device to generate enough heat to cause the sensor to lose resilience and/or melt and thereby release the conduction element.

Figure 17:
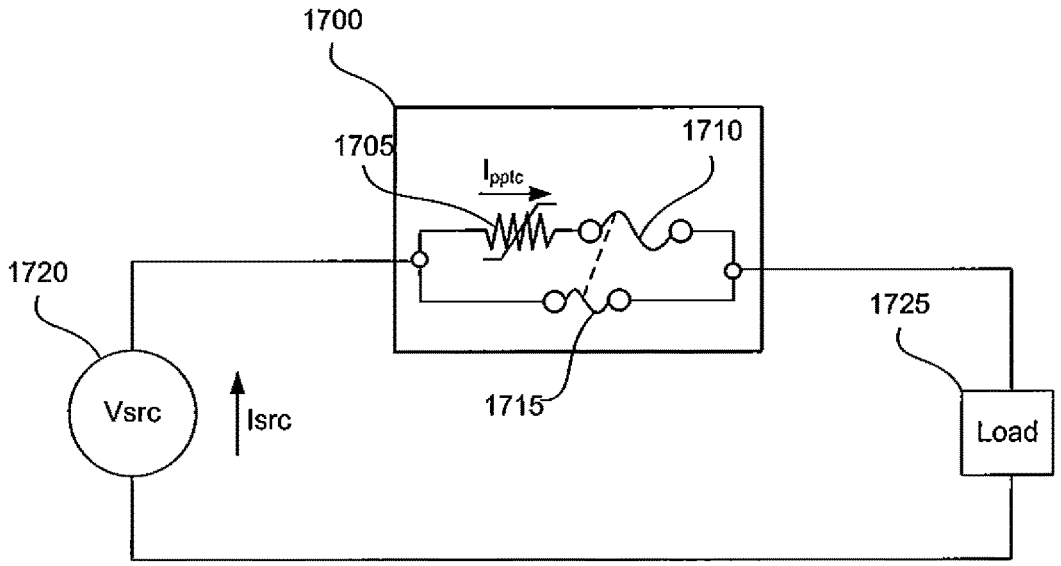
FIG. 17 is a schematic representation of a reflowable thermal fuse.

FIG. 17 is a schematic representation of a reflowable thermal fuse 1700. The reflowable thermal fuse 1700 includes a positive-temperature-coefficient (PTC) device 1705, a conduction element 1710, and a restraining element 1715. The PTC device 1705, conduction element 1710, and restraining element 1715 may be arranged within a housing, such as the housing 1800 shown in FIG. 18.

Figure 18:
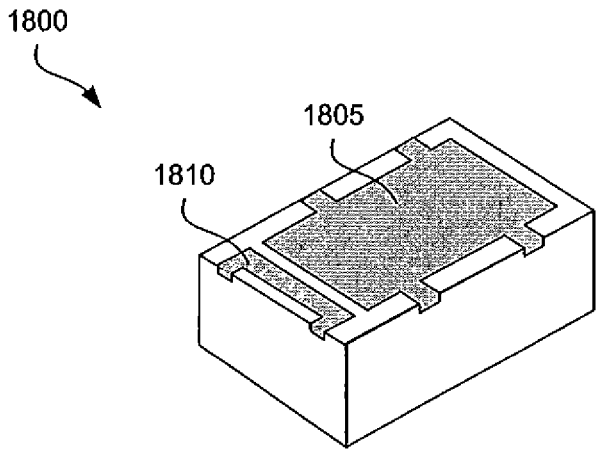
FIG. 18 is a bottom perspective view of an embodiment of a housing that may be utilized in connection with the reflowable thermal fuse.

As shown in FIG. 18, the housing 1800 may include first and second mounting pads 1810 and 1805. The first and second mounting pads 1810 and 1805 may be utilized to bring circuitry disposed on a circuit panel into electrical communication with the PTC device 1705, conduction element 1710, and/or restraining element 1715 disposed within the housing 1800. In alternative embodiments, the PTC device 1705, conduction element 1710, and restraining element 1715 may be arranged on a substrate, a circuit board, or a combination of the substrate, circuit board and/or housing.

Referring back to FIG. 17, the PTC device 1705 corresponds to an electrical device with first and second ends. The PTC device 1705 may correspond to a non-linear device with a resistance that changes in relation to the temperature of the PTC device 1705. The relationship between the resistance and temperature of the PTC device 1705 is shown in the graph of FIG. 19.

Figure 19:
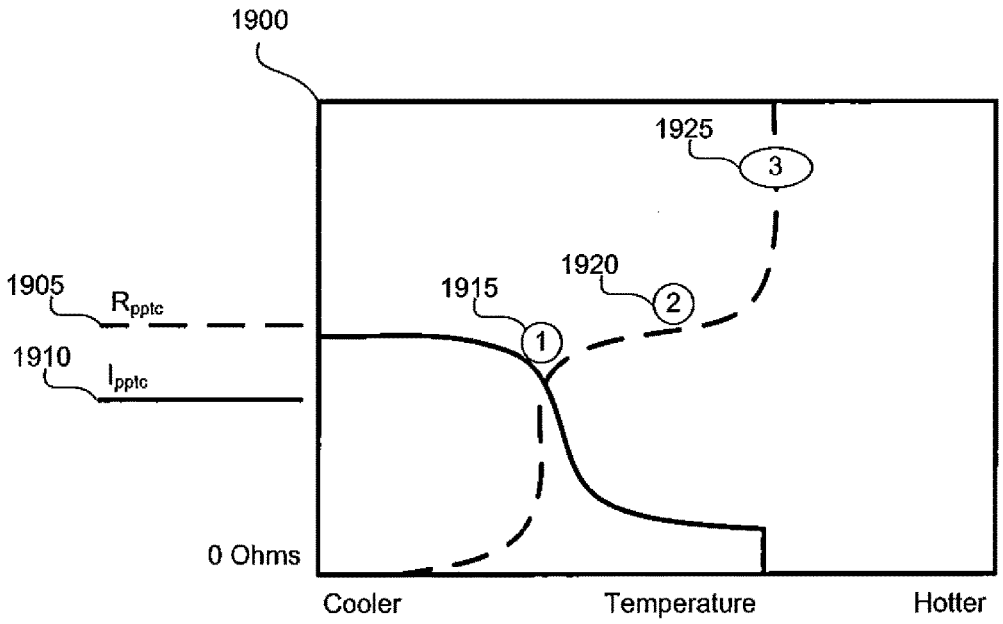
FIG. 19 is a graph that shows the relationship between the resistance and temperature of a PTC device utilized in connection with the reflowable thermal fuse.

Referring to FIG. 19, the horizontal axis of the graph represents the temperature PTC device 1705. The vertical axis of the graph represents both the resistance 1905 of the PTC device 1705 and the current 1910 that flows through the PTC device 1705. As shown, at cooler temperatures, the resistance 1905 of the PTC device 1705 is relatively low. For example, the resistance 1905 may be less than about 10 milliohms. As the temperature increase, the resistance 1905 begins a sharp increase, as represented by region 1 1915. As the temperature continues to increase, the resistance 1905 enters a linear region 2 1920. Finally, further increases in temperature place the PTC device 1705 into a third region 1925 where another sharp increase in resistance 1905 occurs.

The current 1910 through the PTC device 1705 corresponds to the resistance 1905 of the PTC device 1705 over the voltage across the PTC device 1705. The current 1910 may be inversely proportional to the resistance 1905 of the PTC device 1705. As shown, as the resistance 1905 increases, the current 1910 decreases until almost no current flows through the PTC device 1705.

Referring back to FIG. 17, the conduction element 1710 includes first and second ends with one end in electrical communication with the PTC device 1705. In some embodiments, the conduction element 1710 includes a sensor that releasably secures the conduction element into electrical communication with the second end of the PTC device fuse. The sensor may correspond to any material that melts at the activation temperature of the thermal fuse. For example, the material may correspond to a solder that melts at about 200° C. Other materials that melt at higher or lower temperatures may also be used. The conduction element may also include a portion that is under a spring-like tension so that when the sensor melts, the conduction element mechanically opens, thus preventing current from flowing through the conduction element 1710.

The restraining element 1715 may include a first end in electrical communication with the first end of the PTC device 1705 and a second end in electrical communication with a second end of the conduction element 1710. The restraining element 1715 is adapted to prevent the conduction element 1710 from coming out of electrical communication with the PTC device 1705 during an installation state of the reflowable thermal fuse 1700. For example, one end of the restraining element 1715 element may be physically attached to the conduction element 1710 and the other end may be physically attached to the housing and/or substrate.

The restraining element 1715 may correspond to any material capable of conducting electricity. For example, the restraining element 1715 may be made of copper, stainless steel, or an alloy. The diameter of the restraining element 1715 may be sized so as to enable blowing, or opening, the restraining element 1715 during a fault condition. In one embodiment, the restraining element 1715 opens when a current of about 1 Ampere flows through it. Applicants contemplate that the restraining element 1715 may be increased or decrease in diameter, and/or another dimension, allowing for higher or lower currents.

Figure 20A:
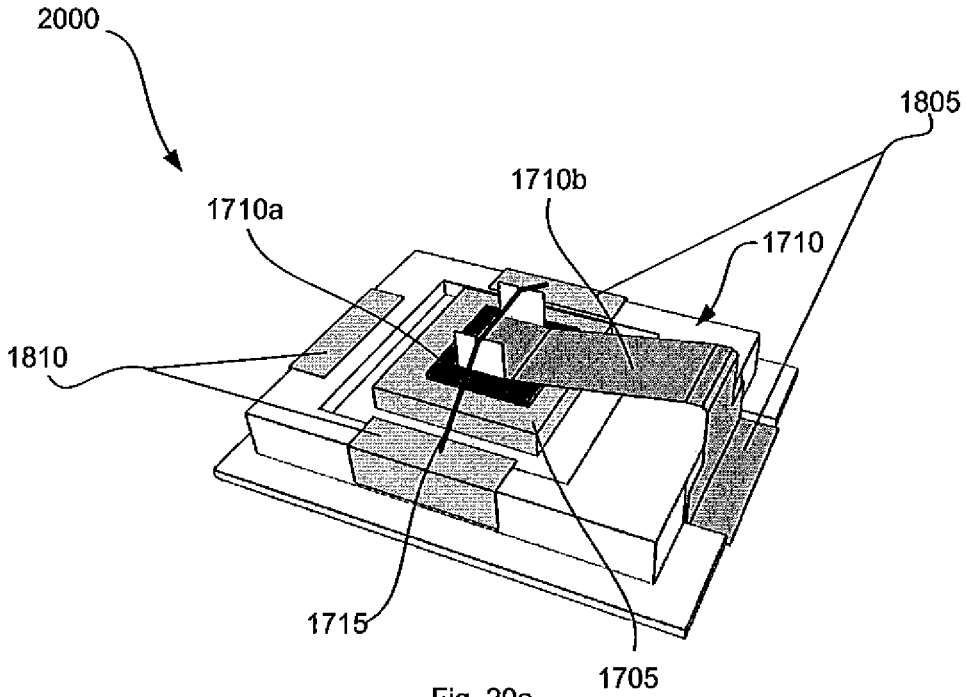
FIGS. 20*a*-20*b* are an exemplary mechanical representation of the reflowable thermal fuse of 17.
Figure 20B:
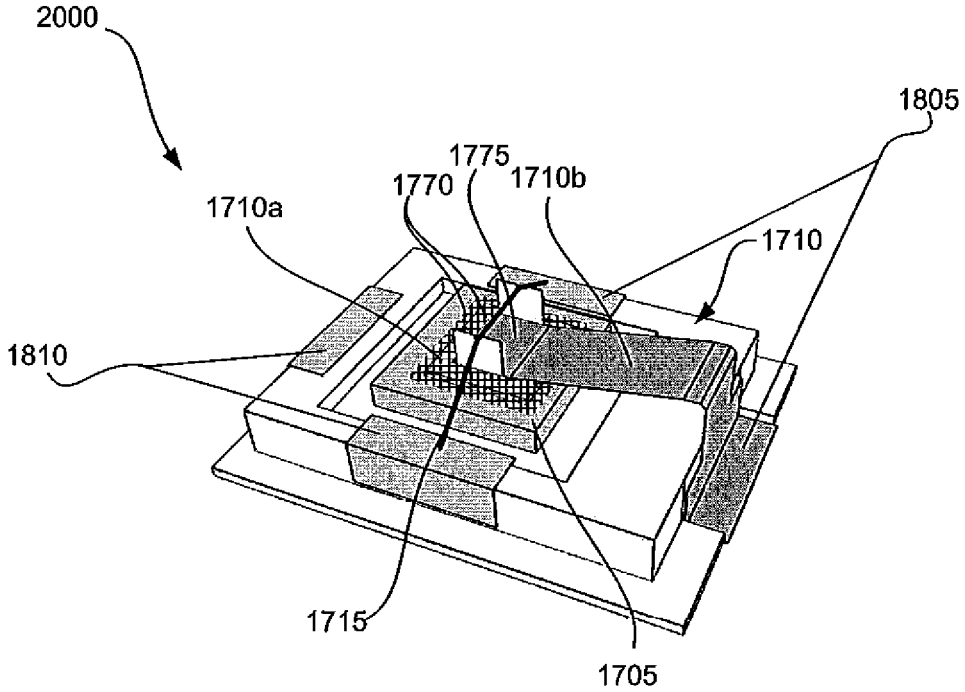

FIGS. 20*a*-20*b* show an exemplary mechanical representation 2000 of the reflowable thermal fuse 1700 of FIG. 17. FIG. 20*b* shows the fuse 1700 with a flux 1770 applied to the sensor 1710*a*, while FIG. 20*a* shows the fuse without a flux. In the exemplary embodiment, the conduction element 1710 includes a sensor 1710*a* and a spring portion 1710*b*. A first end of the conduction element 1710 may be in electrical communication with a first pad 1805 and a second end of the conduction element 1710 may be in electrical communication with a first end of the PTC device 1705. The sensor 1710*a* of the conduction element 1710 may be made of a material that melts or otherwise loses its holding strength at an activation temperature, such as 200° C. The spring portion 1710*b* may be under tension so that when the sensor 1710*a* loses its holding strength, the conduction element separates from the PTC device 1705.

The PTC device 1705 may be disposed below the conduction element 1710, as shown. A first end of the PTC device 1705 may be in electrical communication with a second pad 1810.

The restraining element 1715 may be draped over a portion of the conduction element 1710 and fixed to the first and second pads 1805 and 1810 as shown.

As noted, FIG. 20*b* shows the fuse 1700 with a flux 1770 applied to the sensor 1710*a* and adjacent areas. After application of the restraining element 1715, the flux 1770 may be applied, such as on a top surface 1775 of the portion of the spring portion 1710*b* that is above the sensor 1710*a*. The flux 1770 is then heated and melted. The melted flux spreads out from the top 1775 of the spring portion 1710*b* to cover a portion of the sensor 1710*a* not covered by the spring portion 1710*b*, as well as to cover other adjacent areas such as part of the PTC device 1705. When cooled, the cooled flux 1770 forms a thin film over the portion of the sensor 1710*a* and adjacent areas.

While the flux 1770 may be made of the material described above with respect to the flux 138, flux 1070, flux 1370, flux 1470 or flux 1570, including having a melting point that is less than the melting point of the sensor 1710*a*, for low temperature applications, i.e. those requiring an opening temperature of about 110° C. or less and thus often using a low temperature solder, it is particularly preferred to use a flux comprising a mixture of at least two components. The first component comprises a polar material, e.g., an acid such as a carboxylic acid, and the second component comprises a non-polar material, e.g. a wax, such as a polyethylene wax. The mixture of first and second components in the flux provides a precise melting temperature. The first component acts to reduce surface tension of molten low temperature solder in sensor 1710*a* that can occur in a fault condition, thus minimizing solder bridging that could prevent the device from opening. The second component acts to reduce the force of the spring portion 1710*b* on the low temperature solder in the sensor, thus reducing creep of the low temperature solder that may occur during normal operation and exposure to various thermal conditions. The mixture of first and second components for low temperature applications generally provides an advantage over using carboxylic acid alone, as the mixture generally has a higher viscosity that prevents leakage of the flux under a cover, if present.

The first component is preferably a long chain, linear primary carboxylic acid. A preferred carbon chain length is 25 to 50 carbons. An example of a suitable carboxylic acid is UNICID™ 700 acid, having a melting point of 110° C. and an acid number of 63 (mg KOH/g sample), available from Baker Hughes Incorporated.

The second component is preferably a polyethylene wax, particularly a fully saturated homopolymer of ethylene with a high degree of linearity and a narrow melt distribution. An example of a suitable polyethylene wax is HI-WAX™ 400P wax having a melting point of 126° C. and a melt viscosity of 650 mPa-s, available from TOYO International Co., Ltd. Other appropriate polyethylene waxes are available from the Baker Petrolite Polymers Division of Baker Hughes Incorporated and are sold under the tradename POLYWAX, e.g. POLYWAX 2000 which has a melting point of 126° C.

The flux comprises 98% to 2% by weight of the first component and 2% to 98% by weight of the second component, preferably 75% to 25% by weight of the first component and 25% to 75% by weight of the second component, with the relative amounts selected to optimize the performance under temperature aging conditions (e.g. storage at elevated temperature) and operating conditions. In one embodiment, the first and second components were mixed in a 50:50 ratio by weight. The two components may be mixed by any suitable method, e.g. by melting, with subsequent application onto sensor 1710*a* and adjacent areas via any suitable means.

Because the first and second components of the flux are polar and non-polar, respectively, during a reflow operation when the flux melts it has a propensity to separate into the individual components. The first component generally will flow toward sensor 1710*a*, as the polar material is more attracted by any solder that is present, and the second component generally stays in the vicinity of spring portion 1710*b*.

Figure 21:
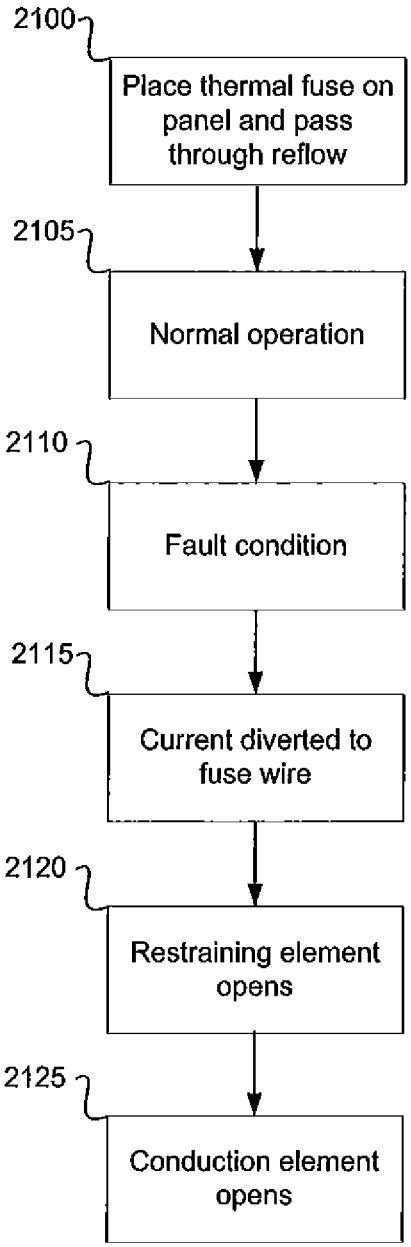
FIG. 21 is a flow diagram that describes operations of the reflowable thermal fuse of FIG. 17.

FIG. 21 is a flow diagram that describes operations of the reflowable thermal fuse 1700 of FIG. 17. At block 1900, the reflowable thermal fuse 1700 is placed on a panel. Solder paste may have been previously applied to the pad locations on the panel associated with the reflowable thermal fuse 1700 via a masking process. The panel, with the reflowable thermal fuse, is then placed into a reflow oven, which causes the solder on the pads to melt.

During the reflow process, the sensor of the conduction element may lose its holding strength. For example, in a sensor made of solder, the solder and flux may melt. However, the solder may be held in place via the surface tension of the solder. The restraining element may prevent the conduction element from mechanically opening during the reflow process. After reflowing, the panel is allowed to cool at which time the sensor may once again regain its holding strength.

At block 2105, the reflowable thermal fuse 1700 may be utilized in a non-fault condition state. Referring to FIG. 17, during this mode of operation, current flowing from a source 1720 through the reflowable thermal fuse 1700 to a load 1725 may flow through the serial circuit formed between the PTC device 1705 and the conduction element 1710 and also flow in parallel via the restraining element 1715. The amount of current flowing through the restraining element 1715 may be less than the amount of current necessary to mechanically open the restraining element 1715.

At block 2110, a fault condition may occur. For example, the ambient temperature in the vicinity of the reflowable thermal fuse 1700 may increase to a dangerous level, such as 200° C.

At block 2115, the resistance of the PTC device 1705 may begin to increase with increases in the ambient temperature, as described in FIG. 18. As the resistance of the PTC device 1705 increases, current flowing into the PTC device 1705 may be diverted to the restraining element 1715.

At block 2120, the current flowing through the restraining element 1715 reaches a point that causes the restraining element 1715 to mechanically open, thus releasing the conduction element 1710.

At block 2125, the conduction element 1710 may mechanically open. The conduction element 1710 may open immediately after the restraining element 1715 releases the conduction element 1710. For example, the sensor 1710*a* of the conduction element 1710 may have already lost its holding strength. The flux 1770, having a lower melting point than the sensor 1710*a*, may have also previously melted. Alternatively, the ambient temperature around the reflowable thermal fuse 1700 may continue to increase and the sensor may give way at an elevated temperature. In yet another alternative, the current flowing into the reflowable thermal fuse 1700 and through the PTC device 1705 may cause the PTC device 1705 to self heat to temperature sufficient enough to cause the flux 1770 to melt and the sensor of the conduction element 1710 to lose its holding strength.

As can be seen from the description above, the reflowable thermal fuse overcomes the problems associated with placement of thermal fuses on panels via reflow ovens. The restraining element enables securing the conduction element during the reflow process. Then during a fault condition, the PTC device effectively directs the current flowing through the reflowable thermal fuse to the restraining element, which in turn causes the restraining element to open. This in turn releases the conduction element.

While the reflowable thermal fuse shown and described in FIGS. 18-22 and the method for using the reflowable thermal fuse have been described with reference to certain embodiments, it will be understood by those skilled in the art that various changes may be made and equivalents may be substituted without departing from the scope of the claims of the application. In addition, many modifications may be made to adapt a particular situation or material to the teachings without departing from its scope. Therefore, it is intended that reflowable thermal fuse shown and described in FIGS. 18-22 and method for using the reflowable thermal fuse are not to be limited to the particular embodiments disclosed, but to any embodiments that fall within the scope of the claims.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A circuit protection device comprising:

a substrate comprising a first electrode and a second electrode;

a sliding contact disposed on the substrate;

a sensing element electrically coupled to the first electrode, the second electrode and the sliding contact;

a flux disposed around the sensing element in the form of a film; and a spring element, wherein the spring element is disposed in an opening of the substrate and held in tension by the sliding contact;

wherein the sensing element resists a force exerted on the sliding contact by the spring element on the sensing element until, upon detection of an activation condition, the sensing element loses resilience and the force exerted on the sliding contact by the spring element causes the spring element to sever the electrical connection.

2. The circuit protection device of claim 1, wherein the flux comprises carboxylic acid.

3. The circuit protection device of claim 1, wherein the flux has a melting point that is less than a melting point of the sensing element.

4. The circuit protection device of claim 1, wherein the flux has a viscosity of less than approximately 150 centipoise.

5. The circuit protection device of claim 1, wherein the flux has an acid number of at least approximately 30.

6. The circuit protection device of claim 1, wherein the flux comprises a mixture of carboxylic acid and a polyethylene wax.

7. The circuit protection device of claim 6, wherein the mixture has a melting point less than a melting point of the sensing element.

8. A circuit protection device, comprising:

a substrate comprising a first electrode and a second electrode;

a sliding contact disposed on the substrate;

a sensing element electrically coupled to the first electrode, the second electrode and the sliding contact;

a flux disposed around the sensing element in the form of a film, said flux comprising a first component that is a polar material and a second component that is a non-polar material; and a spring element, wherein the spring element is disposed in an opening of the substrate and held in tension by the sliding contact;

wherein the sensing element resists a force exerted on the sliding contact by the spring element on the sensing element until, upon detection of an activation condition, the sensing element loses resilience and the force exerted on the sliding contact by the spring element causes the spring element to sever the electrical connection.

9. The circuit protection device of claim 8, wherein the first component of the flux comprises carboxylic acid.

10. The circuit protection device of claim 8, wherein the second component of the flux comprises a wax.

11. The circuit protection device of claim 10, wherein the wax comprises a polyethylene wax.

12. The circuit protection device of claim 8, wherein the flux comprises a mixture of carboxylic acid and a polyethylene wax.

13. The circuit protection device of claim 12, wherein the mixture has a melting point that is less than a melting point of the sensing element.

14. The circuit protection device of claim 8, wherein the flux has a viscosity of less than approximately 150 centipoise.

15. The circuit protection device of claim 8, wherein the flux has an acid number of at least approximately 30.

* * * * *